US005386858A

United States Patent [19]

Sanders et al.

[11] Patent Number: 5,386,858

[45] Date of Patent: Feb. 7, 1995

[54] FUEL DISPENSING SYSTEM, HOSE ASSEMBLY AND COUPLINGS THEREFOR AND METHODS OF MAKING THE SAME

[75] Inventors: John D. Sanders, Springfield, Mo.; Gary R. Long, Stourport-on-Severn, Great Britain

[73] Assignee: Dayco Products, Inc., Dayton, Ohio

[21] Appl. No.: 123,018

[22] Filed: Sep. 16, 1993

Related U.S. Application Data

[62] Division of Ser. No. 849,265, Mar. 11, 1992, Pat. No. 5,285,826.

[51] Int. Cl.[6] ..... B65B 31/00

[52] U.S. Cl. ..... 141/59; 141/44; 141/392

[58] Field of Search ..... 141/44, 45, 46, 59, 141/392; 285/133.1, 12, 137.1, 138; 138/119; 128/DIG. 911; 137/625.23, 597

[56] References Cited

U.S. PATENT DOCUMENTS

| | | | |
|---|---|---|---|
| 3,406,748 | 10/1968 | Jarreby | 138/114 |
| 3,890,112 | 6/1975 | Aldridge | 48/214 |
| 3,918,493 | 11/1975 | Tobias | 137/625.23 |
| 4,938,251 | 7/1990 | Furrow et al. | 137/269 |
| 4,951,720 | 8/1990 | Grantham | 141/44 |
| 5,056,829 | 10/1991 | Kramer | 285/12 |

*Primary Examiner*—Henry J. Recla
*Assistant Examiner*—David J. Walczak
*Attorney, Agent, or Firm*—Joseph V. Tassone

[57] ABSTRACT

A fuel dispensing system, hose assembly and couplings therefor and methods of making the same are provided, the fuel dispensing system comprising a fuel dispensing nozzle construction having an outer fuel receiving inlet and an inner vapor outlet, a fuel dispensing pump construction having an outer fuel dispensing outlet and an inner vapor inlet, and a hose assembly having a first fluid passage therein for conveying fuel from the outer fuel dispensing outlet to the outer fuel receiving inlet and a second fluid passage therein for returning vapors from the inner vapor outlet to the inner vapor inlet, the hose assembly comprising a flexible inner hose having an outer peripheral surface and defining an inner fluid passage therein, and a flexible outer hose having an inner peripheral surface and being disposed around the inner hose, the inner peripheral surface of the outer hose and the outer peripheral surface of the inner hose defining an outer fluid passage therebetween, the inner fluid passage comprising the first fluid passage and the outer fluid passage comprising the second fluid passage.

36 Claims, 11 Drawing Sheets

FUEL DISPENSING SYSTEM, HOSE ASSEMBLY AND COUPLINGS THEREFOR AND METHODS OF MAKING THE SAME

CROSS REFERENCE TO RELATED APPLICATIONS

This application is a divisional patent application of its copending parent patent application, Ser. No. 849,265, filed Mar. 11, 1992, now U.S. Pat. No. 5,285,826.

BACKGROUND OF THE INVENTION

1. Field of the Invention

This invention relates to a new fuel dispensing system and to a new hose assembly and to a new coupling therefor as well as to new methods of making the fuel dispensing system, the hose assembly and the couplings.

2. Prior Art Statement

It is known to provide a fuel dispensing system comprising a fuel dispensing nozzle construction having an outer fuel receiving inlet and an inner vapor outlet, a fuel dispensing pump construction having an outer fuel dispensing outlet and an inner vapor inlet, and a hose assembly having a first fluid passage therein for conveying fuel from said outer fuel dispensing outlet to said outer fuel receiving inlet and a second fluid passage therein for returning vapors from the inner vapor outlet to the inner vapor inlet, the hose assembly comprising a flexible inner hose having an outer peripheral surface and defining an inner fluid passage therein and a flexible outer hose having an inner peripheral surface and being disposed around the inner hose, the inner peripheral surface of the outer hose and the outer peripheral surface of the inner hose defining an outer fluid passage therebetween, the inner fluid passage comprising the second fluid passage and the outer fluid passage comprising the first fluid passage. For example, see FIG. 28 of the drawings of this patent application.

It is also known to provide a fuel dispensing system comprising a fuel dispensing nozzle construction having an inner fuel receiving inlet and an outer vapor outlet, a fuel dispensing pump construction having an inner fuel dispensing outlet and an outer vapor inlet, and a hose assembly having a first fluid passage therein for conveying fuel from the inner fuel dispensing outlet to the inner fuel receiving inlet and a second fluid passage therein for returning vapors from the outer vapor outlet to the outer vapor inlet, the hose assembly comprising a flexible inner hose having an outer peripheral surface and defining an inner fluid passage therein, and a flexible outer hose having an inner peripheral surface and being disposed around the inner hose, the inner peripheral surface of the outer hose and the outer peripheral surface of the inner hose defining an outer fluid passage therebetween, the inner fluid passage comprising the first fluid passage and the outer fluid passage comprising the second fluid passage. For example, see the Basham U.S. Pat. No. 3,980,112, and the Grantham U.S. Pat. No. 4,951,720.

SUMMARY OF THE INVENTION

It is one of the features of this invention to utilize a hose assembly, that is normally utilized to convey fuel through an inner hose thereof and to return vapors in the outer passage thereof that is defined between an outer hose and the inner hose, in a fuel dispensing system that normally utilizes a hose assembly wherein the fuel is conveyed through the passage means defined between the outer hose and the inner hose and the vapor is returned through the inner hose.

In particular, it was found according to the teachings of this invention that unique couplings or adapters can be formed to respectively couple the ends of a hose assembly, that has been constructed to normally convey fuel through the inner hose thereof, to a fuel dispensing pump construction and to a fuel dispensing nozzle construction even though the fuel dispensing pump construction and the fuel dispensing nozzle construction are constructed to normally be utilized with a hose assembly that has the fuel conveyed through the outer fluid passage thereof that is defined between the inner hose and the outer hose of hose assembly and has the vapor conveyed through the inner passage of the inner hose.

For example, one embodiment of this invention comprises a fuel dispensing system comprising a fuel dispensing nozzle construction having an outer fuel receiving inlet and an inner vapor outlet, a fuel dispensing pump construction having an outer fuel dispensing outlet and an inner vapor inlet, and a hose assembly having a first fluid passage therein for conveying fluid from the outer fuel dispensing outlet to the outer fuel receiving inlet and a second fluid passage therein for returning vapors from the inner vapor outlet to the inner vapor inlet, the hose assembly comprising a flexible inner hose having an outer peripheral surface and defining an inner fluid passage therein and a flexible outer hose having an inner peripheral surface and being disposed around the inner hose, the inner peripheral surface of the outer hose and the outer peripheral surface of the inner hose defining an outer fluid passage therebetween, the inner fluid passage comprising the first fluid passage and the outer fluid passage comprising the second fluid passage.

It is another feature of this invention to utilize a hose assembly that is normally utilized to return vapors through an inner hose thereof and to convey fuel through the outer passage thereof that is defined between an outer hose and the inner hose in a fuel dispensing system that normally utilizes a hose assembly wherein the vapor is returned through the passage means defined between the outer hose and the inner hose and the fuel is conveyed through the inner hose.

In particular, it is believed according to the teachings of this invention that the previously described unique couplings or adapters can be utilized to respectively couple the ends of a hose assembly, that has been constructed to normally convey fuel through the outer fluid passage thereof that is defined between the inner hose and the outer hose of the hose assembly, to a fuel dispensing pump construction and to a fuel dispensing nozzle construction even though the fuel dispensing pump construction and the fuel dispensing nozzle construction are constructed to normally be utilized with a hose assembly that has the fuel conveyed thorugh the inner passage of the inner hose thereof.

For example, another embodiment of this invention comprises a fuel dispensing system comprising a fuel dispensing nozzle construction having an inner fuel receiving inlet and an outer vapor outlet, a fuel dispensing pump construction having an inner fuel dispensing outlet and an outer vapor inlet, and a hose assembly having a first fluid passage therein for conveying fluid from the inner fuel dispensing outlet to the inner fuel receiving inlet and a second fluid passage therein for returning vapors from the outer vapor outlet to the outer vapor inlet, the hose assembly comprising a flexible inner hose having an outer peripheral surface and defining an inner fluid passage therein and a flexible outer hose having an inner peripheral surface and being disposed around the inner hose, the inner peripheral surface of the outer hose and the outer peripheral surface of the inner hose defining an outer fluid passage therebetween, the outer fluid passage comprising the first fluid passage and the inner fluid passage comprising the second fluid passage.

Accordingly, it is an object of this invention to provide a new fuel dispensing system having one or more of the novel features of this invention as set forth above or hereinafter shown or described.

Another object of this invention is to provide a new method of making such a fuel dispensing system, the method of this invention having one or more of the novel features of this invention as set forth above or hereinafter shown or described.

Another object of this invention is to provide a new hose assembly for a fuel dispensing system, the hose assembly of this invention having one or more of the novel features of this invention as set forth above or hereinafter shown or described.

Another object of this invention is to provide a new method of making such a hose assembly, the method of this invention having one or more of the novel features of this invention as set forth above or hereinafter shown or described.

Another object of this invention is to provide a new coupling for one end of a hose assembly for a fuel dispensing system, the coupling of this invention having one or more of the novel features of this invention as set forth above or hereinafter shown or described.

Another object of this invention is to provide a new method of making such a coupling, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
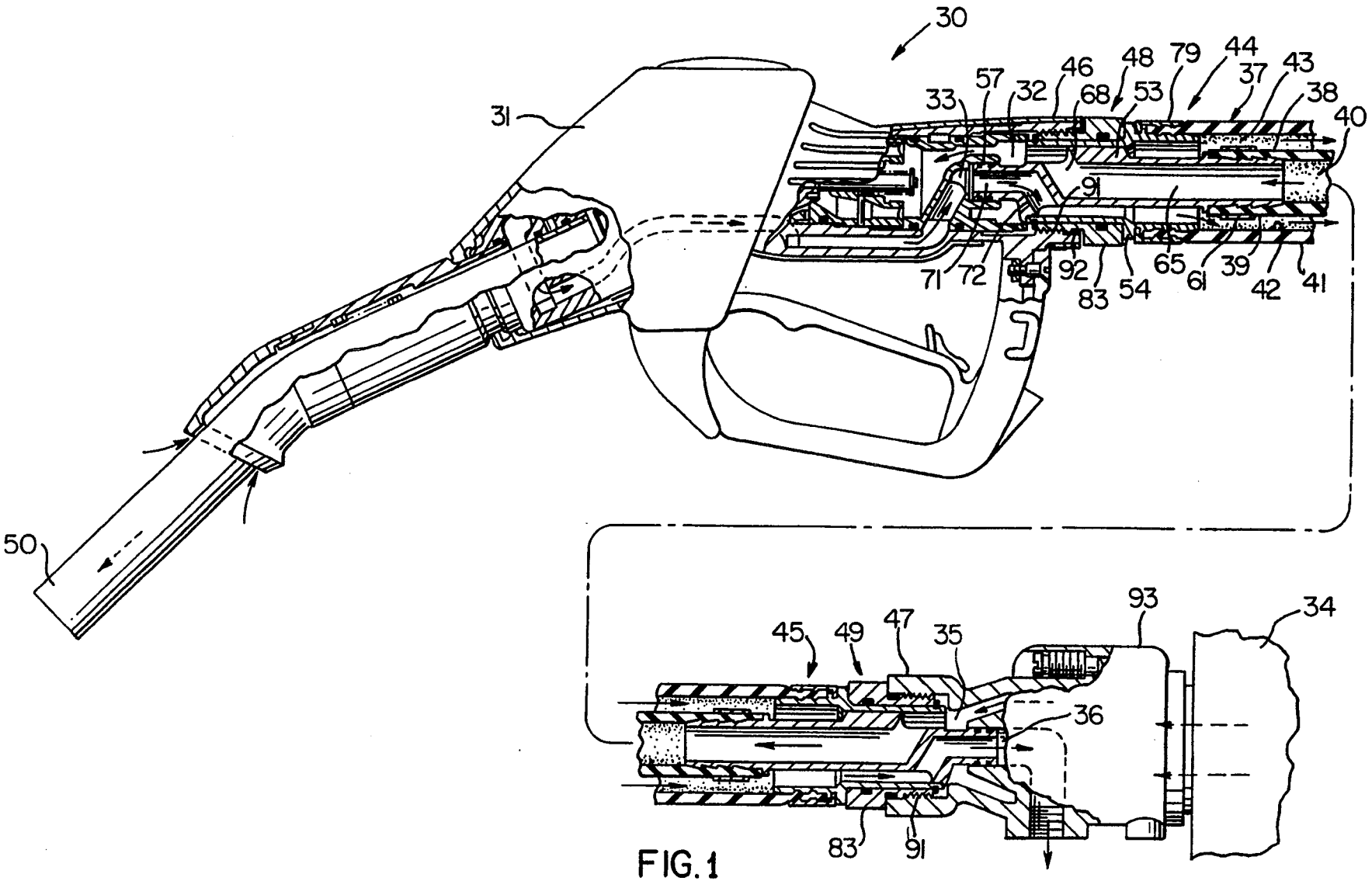
FIG. 1 is a fragmentary view that is partially in cross-section and illustrates a fuel dispensing system of this invention.

While the various features of this invention are hereinafter illustrated and described as being particularly adapted to provide a fuel dispensing system, such as for gasoline for transportation vehicles, it is to be understood that the various features of this invention can be utilized singly or in various combinations thereof to provide a dispensing system for other fluids as desired.

Therefore, this invention is not to be limited to only the embodiments illustrated in the drawings because the drawings are merely utilized to illustrate one of the wide variety of uses of this invention.

Referring now to FIG. 1, a new fuel dispensing system of this invention is generally indicated by the reference numeral 30 and comprises a fuel dispensing nozzle construction 31 having an annular outer fuel receiving inlet 32 and an inner vapor outlet 33 disposed substantially concentrically within the annular outer fuel receiving inlet 32, a fuel dispensing pump construction 34 having an annular outer fuel dispensing outlet 35 and an inner vapor inlet 36 disposed substantially concentrically within the annular outer fuel dispensing outlet 35, and a hose assembly that is generally indicated by the reference numeral 37 and comprising a flexible inner hose 38 having an outer peripheral surface 39 and defining an inner fluid passage 40 therein and a flexible outer hose 41 having an inner peripheral surface 42 and being disposed around the inner hose 38 so that the inner peripheral surface 42 of the outer hose 41 and the outer peripheral surface 39 of the inner hose 38 define an outer fluid passage 43 therebetween.

The hose assembly 37 has opposed ends that are generally indicated by the reference numerals 44 and 45 and are respectively coupled to adjacent ends 46 and 47 of the nozzle construction 31 and pump construction 34 by like couplings of this invention that are respectively and generally indicated by the reference numerals 48 and 49 in FIG. 1, the couplings 48 and 49 being substantially identical and therefore only the coupling 48 will be hereinafter described in detail with the understanding that the coupling 49 has the same details.

However, it is to be understood that one type of coupling of this invention can be utilized with one end of the hose assembly 37 and that another type of coupling that has certain features of this invention can be utilized with the other end thereof so that the opposed ends of the hose assembly 37 need not have exactly the same type of couplings therefor even though the resulting structure causes the hose assembly 37 to function in the manner taught by this invention so that the resulting fluid dispensing system 30 will also function in a manner hereinafter set forth.

The couplings 48 and 49 of this invention, as will be apparent hereinafter, permit the inner fluid passage 40 of the hose assembly 37 to interconnect the outer fuel dispensing outlet 35 of the pump construction 34 to the outer fuel receiving inlet 32 of the nozzle construction 31 so as to be dispensed out of outlet end 50 thereof in a manner well known in the art while permitting the outer fluid passage 43 of the hose assembly 37 to convey fuel vapors from the inner vapor outlet 33 of the nozzle construction 31 to the inner vapor inlet 36 of the pump construction 34 for vapor recovery purposes in a manner that is also well known in the art, the vapors being generated in a manner well known in the art are received by the nozzle construction 31 adjacent the nozzle end 50 in a manner also well known in the art. For example, see the aforementioned Basham U.S. Pat. No. 3,980,112, and the Grantham U.S. Pat. No. 4,951,720, whereby these two patents are being incorporated into this disclosure by this reference thereto.

Thus, it can be seen that the couplings 48 and 49 of this invention readily permit the fuel dispensing system 30 of FIG. 1 to utilize hose assemblies wherein the inner hose has been designed and constructed for conveying volatile liquid fuel therethrough with nozzle constructions and pump constructions that normally utilize hose assemblies therewith which are designed to have the outer fluid passage therein that is defined between the inner hose and the outer hose thereof for conveying the volatile liquid fuel therethrough.

Figure 28:
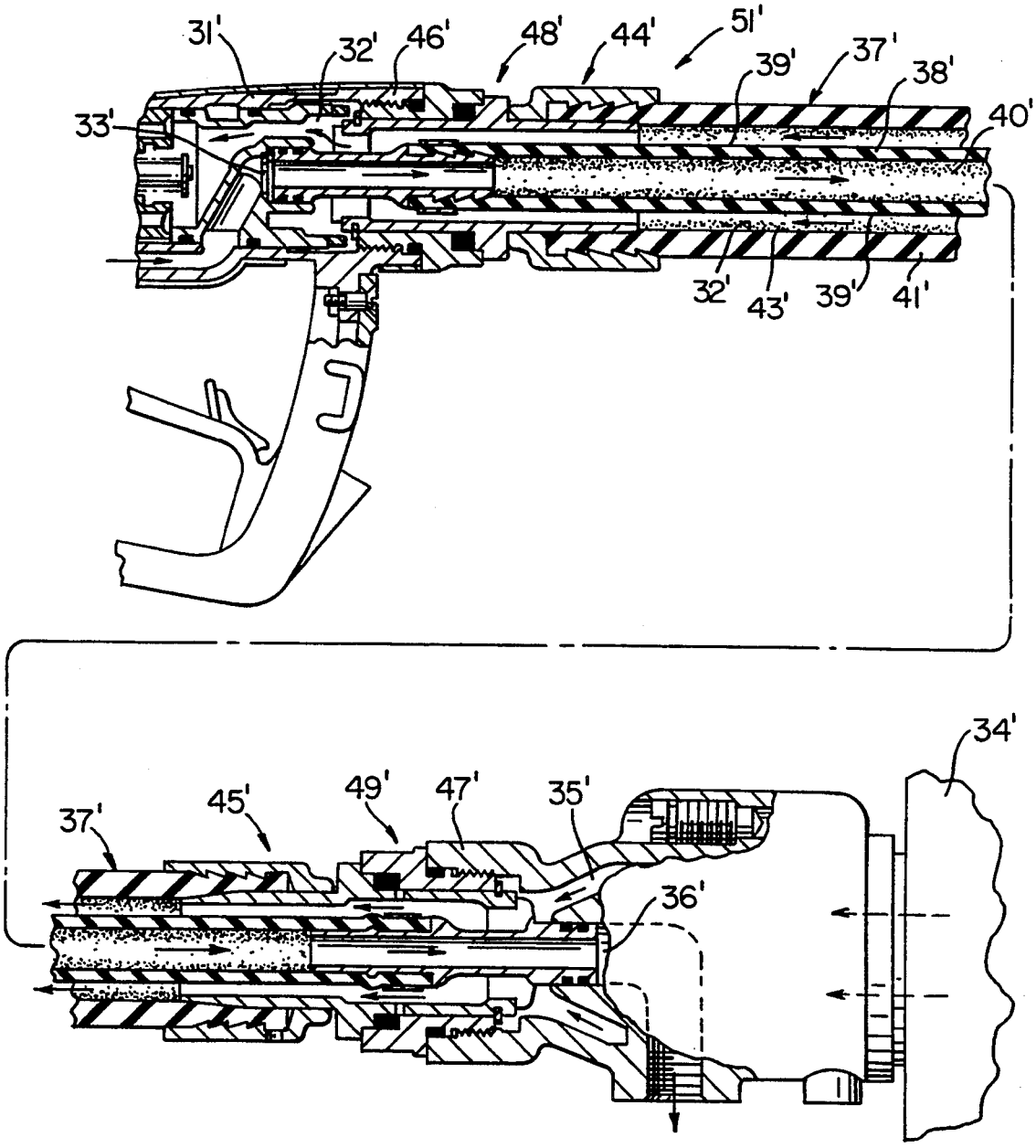
FIG. 28 PRIOR ART
FIG. 28 is a view similar to FIG. 1 and illustrates a prior known fuel dispensing system.

For example, reference is now made to FIG. 28 wherein such prior known fuel dispensing system is generally indicated by the reference numeral 51 and parts thereof similar to the parts of the system 30 of this invention of FIG. 1 are indicated by like reference numerals followed by a prime mark.

The prior known fuel dispensing system 51′ of FIG. 28 comprises the nozzle construction 31′ having the outer annular fuel receiving inlet 32′ and the inner vapor outlet 33′. The prior known fuel dispensing system 51′ also comprises the fuel dispensing pump construction 34′ that has the outer annular fuel dispensing outlet 35′ and the inner vapor inlet 36′.

A hose assembly 37′ has the opposite ends 44′ and 45′ thereof respectively interconnected to the ends 46′ and 47′ of the nozzle construction 31′ and pump construction 34′ by coupling means 48′ and 49?, the hose construction 37′ comprising an inner flexible tubular hose 38′ having an outer peripheral surface 39′ and an inner passage 40′ passing therethrough and interconnecting the inner vapor outlet 33′ of the nozzle construction 31′ with the inner vapor inlet 36′ of the pump construction 34′ by the particular construction of the couplings 48′ and 49′ as illustrated.

The hose construction 37′ also has an outer flexible hose 41′ provided with an inner peripheral surface 42′ that cooperates with the outer peripheral surface 39′ of the inner hose 38′ to define an outer passage 43 ′ that interconnects the outer fuel dispensing outlet 35′ of the pump construction 34′ with the outer fuel receiving inlet 32′ of the nozzle construction 31′ by the particular construction of the couplings 48′ and 49′ as illustrated.

Therefore, it can be seen that in the prior known system 51′ of FIG. 28, the nozzle construction 31′ and the pump construction 34′ have been constructed so that the outer annular openings 32′ and 35′ thereof are to be interconnected by the outer passage means 43′ of the hose assembly 37′ while the inner openings 33′ and 36′ of the nozzle construction 31′ and pump construction 34′ are to be interconnected together by the inner passage 40′ of the inner hose 38′ of the hose assembly 37′, such a fuel dispensing system normally being utilized by certain countries foreign to the United States of America.

However, by utilizing the hose assembly 37 of this invention as set forth in FIG. 1, the prior known nozzle construction 31′ and pump construction 34′ can still have the outer openings 32′ and 35′ thereof interconnected together but the same are interconnected together by the inner passage 40 of the inner hose 38 of the hose assembly 37 through the switching operation of the unique couplings 48 and 49 of this invention. Similarly, the hose assembly 37 of this invention will interconnect together the respective inner openings 33′ and 36′ of the nozzle construction 31′ and the pump construction 34′ through the outer passage 43 of the hose assembly 37 through the unique switching function of the couplings 48 and 49 of this invention as previously set forth.

Therefore it can be seen that the couplings 48 and 49 of this invention permit the hose assembly 37 of this invention to be utilized with fuel dispensing systems wherein the nozzle construction and the pump construction normally have the fuel dispensed between outer annular openings thereof and the vapor returned between the inner openings thereof.

Thus, a hose assembly that has been designed to have the volatile liquid fuel passed through the inner hose thereof can now be used with such nozzle construction 31' and such pump construction 34'.

Conversely, it is to be understood that the couplings 48 and 49 of this invention can be utilized to permit hose constructions that have been designed to normally convey fuel through the outer fluid passage 43' thereof and vapors through the inner passage 40' thereof to be utilized with fuel dispensing systems wherein the nozzle construction and the pump construction normally have the vapors returned between the respective outer annular openings of the nozzle construction and the pump construction and the fuel conveyed between the respective inner openings thereof, such nozzle construction and such pump construction normally being utilized in the United States of America.

For example, reference is now made to FIG. 27 wherein such a fuel dispensing system of this invention is generally indicated by the reference numeral 30E and parts thereof similar to the fuel dispensing systems 30 and 51 previously described are indicated by like reference numerals followed by the reference letter "E." However, this system 30E will be later described.

Figure 2:
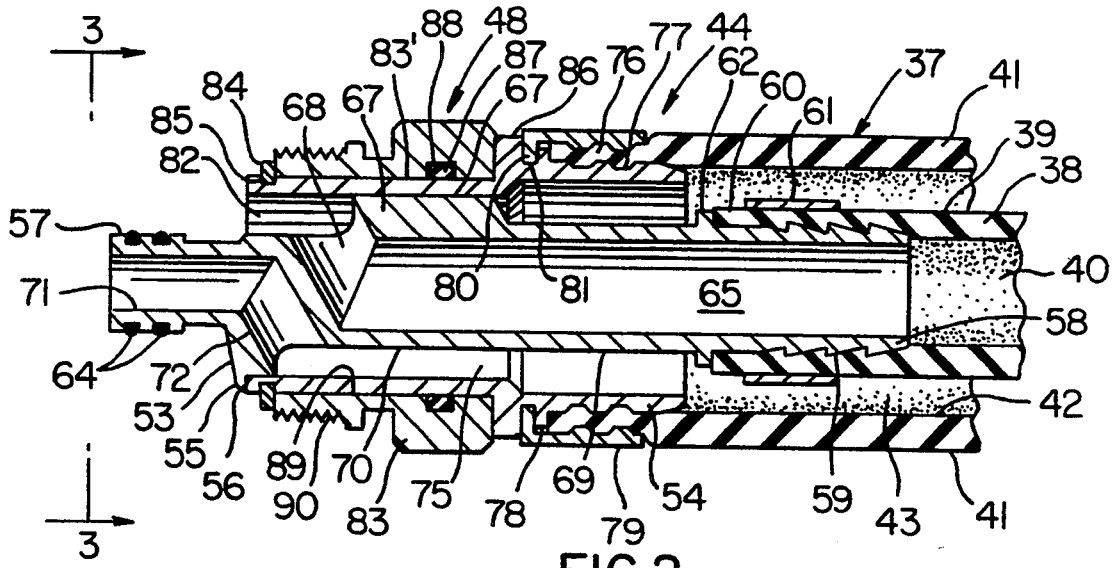
FIG. 2 is an enlarged fragmentary cross-sectional view of one end of the hose assembly of this invention that is utilized in the fuel dispensing system of FIG. 1.
Figure 3:
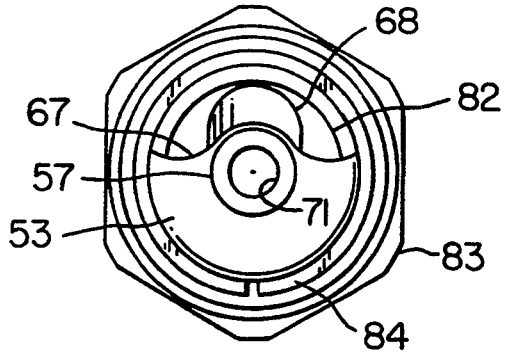
FIG. 3 is an end view of the hose assembly illustrated in FIG. 2 and is taken in the direction of the arrows 3—3 thereof.
Figure 4:
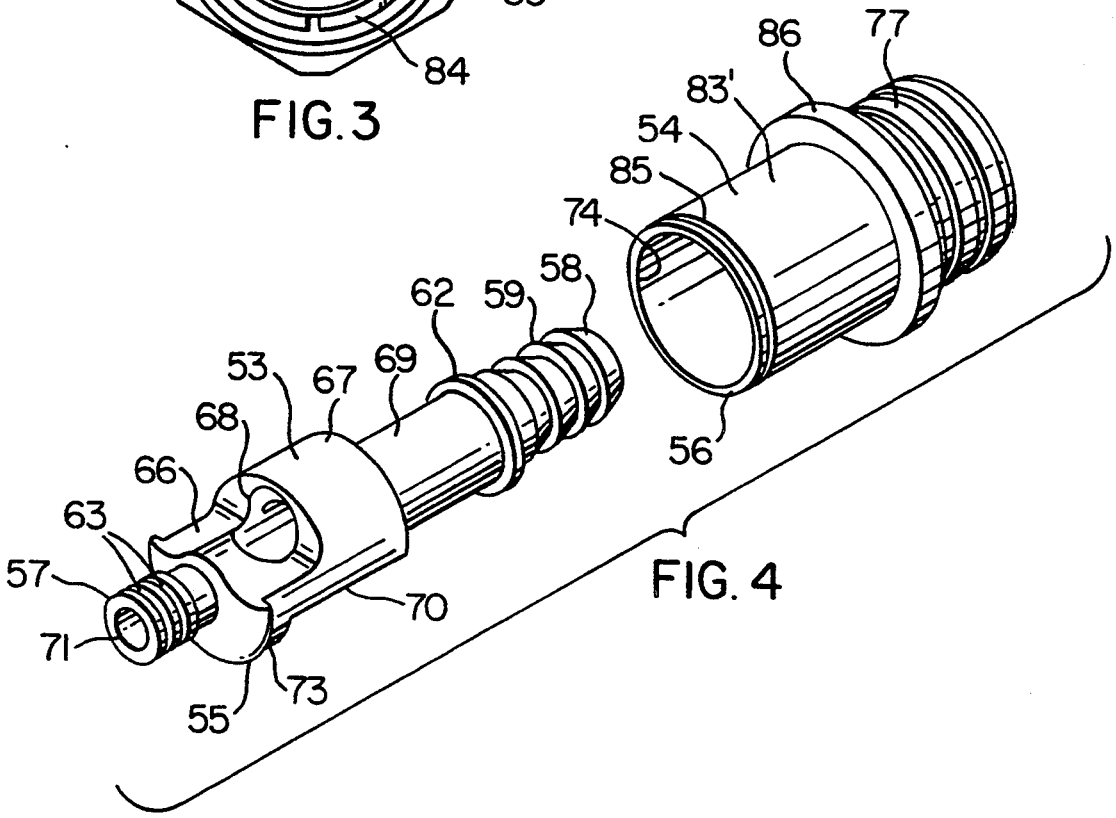
FIG. 4 is an exploded perspective view of two of the parts that form the coupling of this invention that is utilized with the hose assembly of FIGS. 2 and 3.
Figure 5:
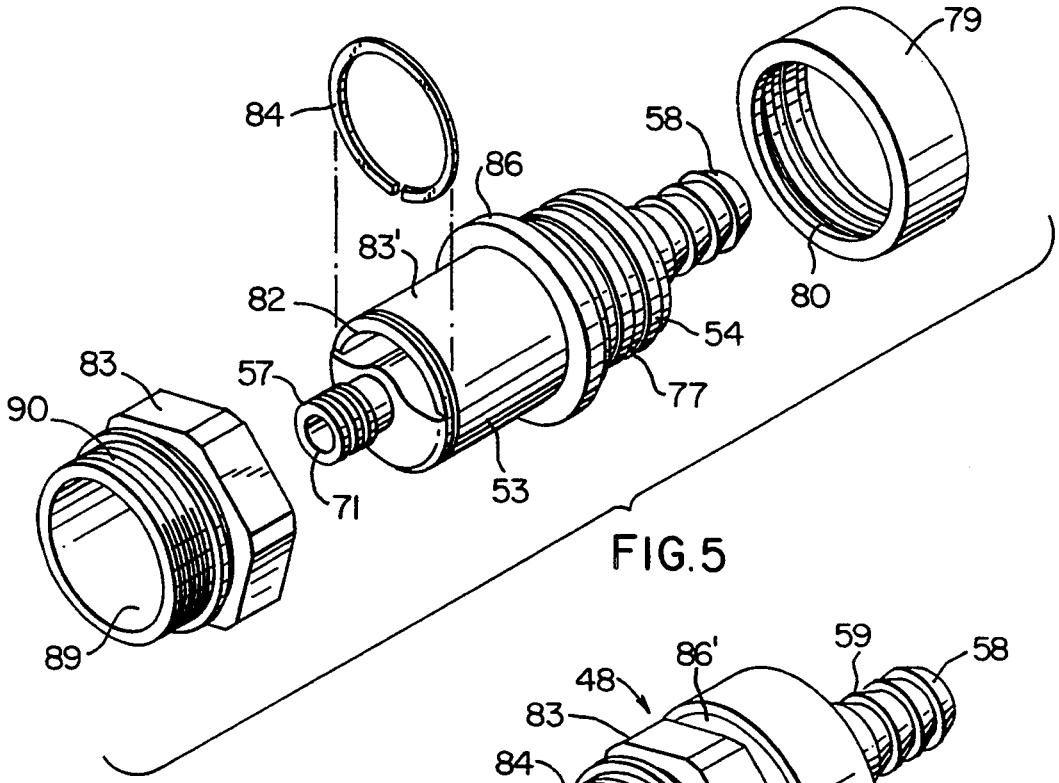
FIG. 5 is an exploded perspective view illustrating other parts of the coupling of this invention.
Figure 6:
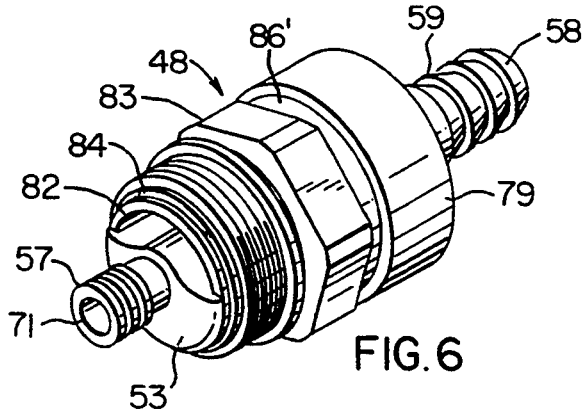
FIG. 6 is a perspective view illustrating the completed coupling of this invention for the hose assembly of FIGS. 1 and 2.

Returning now to the fuel dispensing system 30 of FIG. 1, the coupling 48 of this invention at the end 44 of the hose assembly 37 is illustrated in FIGS. 2–6 and comprises two main parts 53 and 54 formed in the configurations illustrated in FIG. 4 in any suitable manner, such as by casting, machining, etc., and from any suitable material, such as metallic material, the parts 53 and 54 being subsequently secured together in any suitable manner, such as by brazing, after a flange means 55 of the part 53 has engaged against an annular edge means 56 of the part 54 when the part 53 has been fully telescoped within the part 54 as illustrated in FIG. 2.

The part 53 comprises a stem-like member having opposed tubular ends 57 and 58 with the end 58 being provided with suitable annular barbs 59, the end 58 being adapted to be inserted within an end 60 of the inner hose 38 that is subsequently held thereto by an outer annular band 61 that is radially inwardly shrunk in a manner well known in the art and compresses the end 60 of the hose 38 against the barbs 59 on the end 58 of the part 53 as illustrated in FIG. 2 to secure the end 60 of the hose 38 in a butting relation against an annular flange 62 of the part 53 as illustrated.

The end 57 of the part 53 has annular grooves 63 formed therein to respectively receive annular sealing members 64, FIG. 2, therein which will seal the end 57 within the central opening 33 of the nozzle construction 31 in the manner illustrated in FIG. 1 when the end 57 is telescoped therein as illustrated. Such sealing is also provided by the coupling 49 in the central opening 36 of the pump construction 34.

The part 53 of the coupling 48 has a passage 65 passing through the end 58 thereof and then intersecting with a reduced part 66 of an enlarged cylindrical-like section 67 thereof by an angular portion 68 of the passage 65 as illustrated in FIGS. 2, 3 and 4. The cylindrical section 67 extends around a tubular section 69 of the stem part 53 for approximately 180° so that there is a reduced area 70 of the section 67 beyond the annular flange 55 thereof as illustrated in the drawings. A passage 71 extends centrally through the tubular extension 57 of the part 53 and joins with the reduced part 70 of the cylindrical section 67 by an angled portion 72 of the passage 71 as illustrated.

In this manner, when the part 53 is telescoped within the substantially cylindrical tubular part 54, the cylindrical section 67 and a lower portion 73 thereof center the part 53 within the tubular part 54 as illustrated, because the cylindrical sections 67 and 73 engage the internal peripheral surface 74 of the part 54 and also provide cooperating surfaces for subsequently brazing the parts 53 and 54 together. The reduced section 70 and the tubular section 69 of the part 53 cooperate with the tubular part 54 to define a passage means 75 therewith which will fluidly couple to the outer passage 43 of the hose assembly 37 when an end 76 of the outer hose 41 is telescoped onto an annularly grooved end 77 of the part 54 of the coupling 48 and abutted against an annular flange 78 thereof. The end 76 of the hose 41 is compressed against the grooved end 77 of the part 54 by shrinking an annular member 79 radially inwardly in a manner well known in the art, the part 79 having an annular flange 80 disposed in an annular groove 81 of the part 54 as illustrated and in a manner also well known in the art.

In this manner, it can be seen that the inner passage 65 of the coupling aligns with the inner passage 40 of the inner hose 38 so as to be interconnected by the section 68 of the passage 65 to an outer area 82 of the coupling 48 which fluidly interconnects with the annular outer opening 32 of the nozzle construction 31 in the manner illustrated in FIG. 1 regardless of the rotational position therebetween. Likewise, the outer passage 43 of the hose assembly 37 is interconnected by the passage 75 and angled portion 72 thereof to the passage 71 in the tubular part 57 of the coupling 48 which is disposed in fluid communication with the inner opening 33 of the nozzle construction 31 when assembled thereto in the manner illustrated in FIG. 1 regardless of the rotational position therebetween.

In order to couple the coupling 48 of the hose assembly 37 to the nozzle construction 31, a rotatable member 83 is telescoped onto a cylindrical end section 83' of the part and is held thereon by a C-ring or circlip ring 84 that is snapped into an annular groove 85 in the part 54 so that the member 83 is held between the ring 84 and an outwardly directed annular flange 86 of the part 54 to rotate thereon and be sealed thereto by an annular sealing member 87 carried in an annular groove 88 formed in the internal peripheral surface 89 of the member 83.

The member 83 of the coupling 48 has an externally threaded portion 90 which is adapted to thread into an internally threaded opening 91 of the nozzle construction 31 so as to threadedly interconnect the same together in a manner well known in the art and be sealed thereto by an annular sealing member 92 disposed between the rotatable member 83 and the nozzle construction 31 also in a manner well known in the art. Such sealing is also provided in a like manner when the coupling 49 is threaded into the threaded opening 91 of the pump construction 34 as illustrated in FIG. 1.

See the aforementioned Grantham U.S. Pat. No. 4,951,720, for a similar coupling arrangement with a threaded member similar to the threaded member 83.

Thus, a further description of the interconnection of the coupling 48 to the nozzle construction 31 and the coupling 49 to the pump construction 34 need not be further set forth as it is obvious from FIG. 1 that the coupling 49 has the rotatable member 83 thereof coupled to the internally threaded opening 91 of a part 93 of the pump construction 34 that contains the openings 35 and 36 previously described.

Therefore, it can be seen that it is a relatively simple method of this invention to first form the couplings 48 and 49 from the two parts 53 and 54 as previously described and then secure the completed couplings 48 and 49 respectively to the opposed ends of the hoses 38 and 41 to not only hold the inner hose 38 substantially concentrically disposed within the outer hose 41 at the opposed ends thereof but to also switch the inner passage 40 to outer locations and the outer passage 43 to inner locations on the respective couplings 48 and 49 for the purpose previously set forth so as to permit the resulting hose assembly 37 to be utilized with the nozzle construction 31 and the pump construction 34 for the purposes of dispensing fuel from the pump construction 34 out of the nozzle construction 31 while returning vapors of fuel from the nozzle construction 31 back to the pump construction 34 for vapor recovery purposes and for the reasons set forth in the aforementioned Grantham, U.S. Pat. No. 4,951,720, and the aforementioned Basham U.S. Pat. No. 3,980,112.

Figure 7:
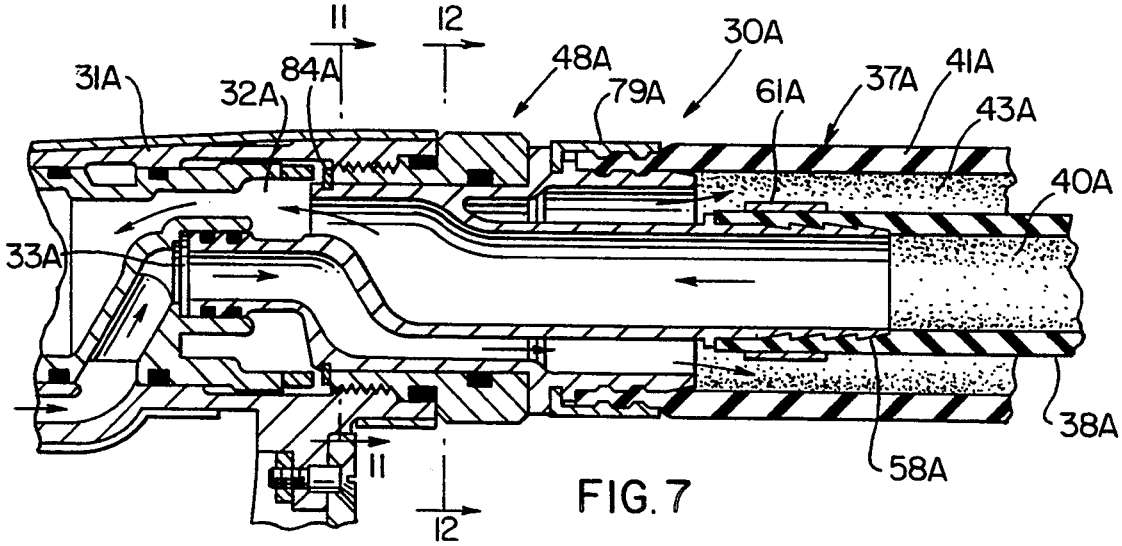
FIG. 7 is an enlarged fragmentary cross-sectional view similar to a part of the fuel dispensing system of FIG. 1 and illustrates another fluid dispensing system of this invention.

Another fuel dispensing system of this invention is generally indicated by the reference numeral 30A in FIG. 7 and parts thereof similar to the fuel dispensing system 30 previously described are indicated by like reference numerals followed by the reference letter "A".

Figure 8:
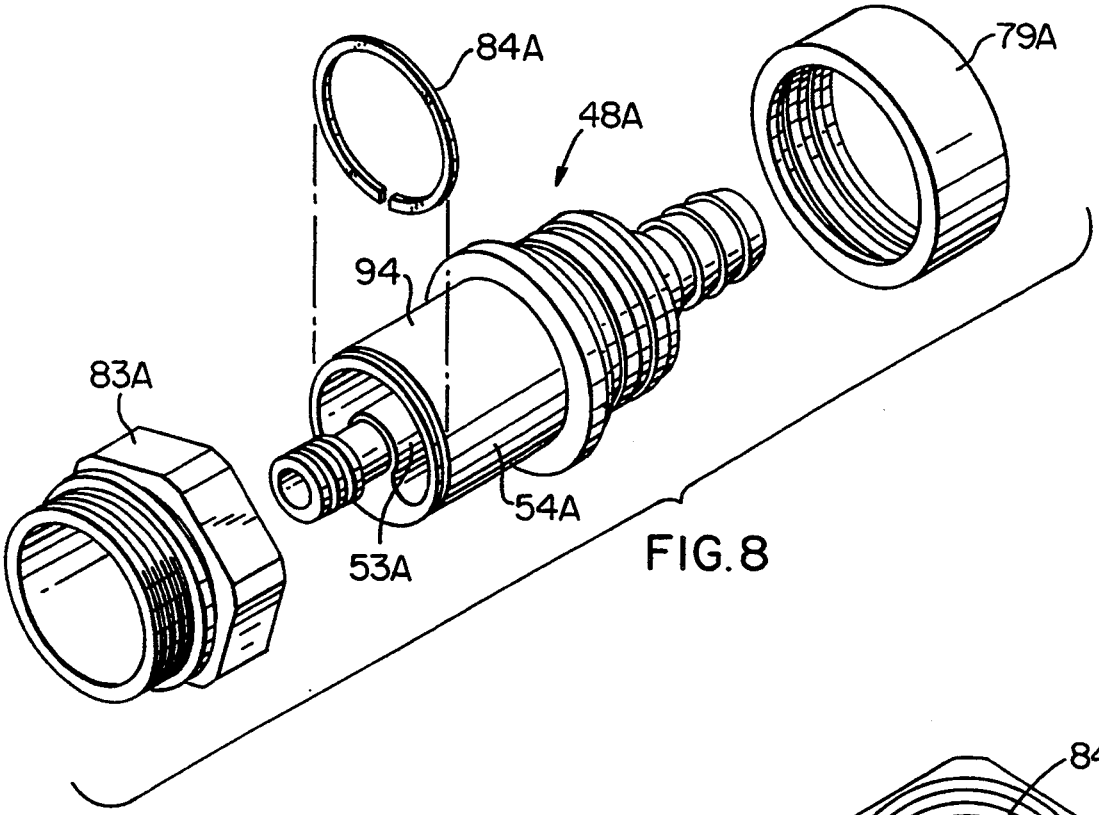
FIG. 8 is an exploded perspective view illustrating the various parts of the coupling for the hose assembly of FIG. 7.
Figure 9:
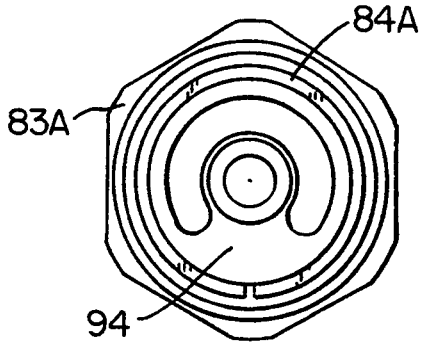
FIG. 9 is an end view of the completed coupling of FIG. 8
Figure 11:
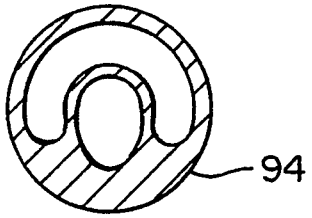
FIG. 11 is a cross-sectional view taken substantially on line 11—11 of FIG. 7.
Figure 12:
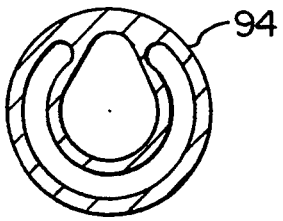
FIG. 12 is a cross-sectional view taken substantially on line 12—12 of FIG. 7.
Figure 10:
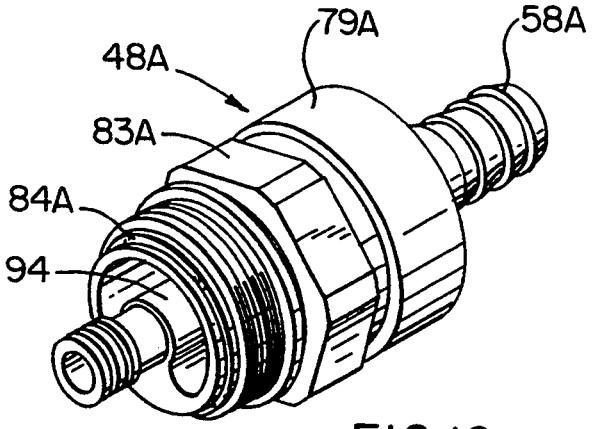
FIG. 10 is a perspective view of the completed coupling of FIG. 8.

The fluid dispensing system 30A of FIG. 7 utilizes another coupling of this invention that is generally indicated by the reference numeral 48A in FIGS. 7–12 and is utilized in substantially the same manner as the coupling 48 to switch the inner passage 40A of the inner hose 38A of the hose assembly 37A to the outer annular inlet 32A of the nozzle construction 31A and to switch the outer passage 43A defined between the outer hose 41A and the inner hose 38A to an inner location which is interconnected to the central inner opening 33A of the nozzle construction 31A in a manner similar to the coupling 48 previously described except that the coupling 48A of the fluid dispensing system 30A has the parts 53A and 54A thereof formed from a single casting so that the coupling 48A comprises a one-piece homogeneous part 94 as illustrated in FIG. 8 to be joined with the snap-ring. 84A, rotatable coupling member 83A and fastening members 79A and 61A to complete the attachment of the coupling 48A to the hoses 38A and 41A in the manner previously described and to couple to the nozzle construction 31A also in the manner previously described.

When interconnecting the coupling 48 or 48A of this invention to form the respective hose assembly 37 or 37A, the outer hose 41 or 41A is first moved in a compressed direction toward its other end to expose the end of the inner hose 38 or 38A so that when the stem portion 53 or 53A has its end 58 or 58A received within the inner hose 38 or 38A, the clamping means 61 or 61A can be disposed in place and then the adjacent end of the outer hose 41 or 41A can be released so that the same then will extend beyond the adjacent end of the inner hose for 38 or 38A so that the outer part 54 or 54A then can be inserted into that end of the outer hose 41 or 41A to permit the member 79 and 79A to subsequently fasten the same together in the manner previously described.

Thus, while the coupling 48 has the two parts 53 and 54 thereof brazed together to form a single unit, the coupling 48A has the parts 53A and 54A cast as a one-piece member 94.

Another fuel dispensing system of this invention is generally indicated by the reference numeral 30B in FIGS. 13–20 and parts thereof similar to parts of the system 30 or 30A previously described are indicated by like reference numerals followed by the reference letter "B".

As illustrated in FIGS. 13–20, the fuel dispensing system 30B is substantially the same as the systems 30 and 31A previously described wherein a coupling 48B of this invention interconnects an end 44B of a hose assembly 37B to a nozzle construction 31B in such a manner that the coupling 48B switches the flow of fuel or gasoline from the inner passage 40B of the inner hose 38B to the outer annular inlet 32B of the nozzle construction 31B while returning the vapor from the inner outlet 33B of the nozzle construction 31B to the outer passage 43B of the hose assembler 37B, it being understood that a similar coupling 49B (not shown) accomplishes the same function as the coupling 49 for interconnecting the hose assembly 37B to a pump construction 34B (not shown) for the same purpose.

The coupling 48B is formed of two main parts 53B and 54B subsequently assembled together in telescoping relation but without securement therebetween except as provided by the holding force of the inner and outer hoses 38B and 41B as will be apparent hereinafter, the part 53B having the cylindrical section 67B extending radially outwardly from the stem section 69B a certain distance throughout 360° and having annular grooves 100 and 101 formed therein with the annular groove 101 receiving an annular sealing member 102 therein for sealing against the internal peripheral surface 74B of the part 54B when the part 53B is telescoped within the part 54B while the annular groove 100 subsequently receives a snap-ring 103 therein for positioning the member 53B relative to the end surface 56B of the part 54B in the manner illustrated in FIG. 13 and as will be apparent hereinafter.

However, it is to be understood that instead of having the snap-ring 103 for abutting the shoulder 56B of the part 54B, a fixed shoulder could be provided on the section 67B of the part 53B to abut against the shoulder 56B of the part 54B when the parts 53B and 54B are assembled together and this would require substantially a permanent assembly which can only be disassembled by cutting the inner hose.

It can be seen that the part 54B of the coupling 49B has the annular groove 85B for receiving the snap-ring 84B therein for retaining the rotatable threaded member 83B for its coupling purpose and has the annular shoulder 86B for retaining the fastening member 79B.

Figure 13:
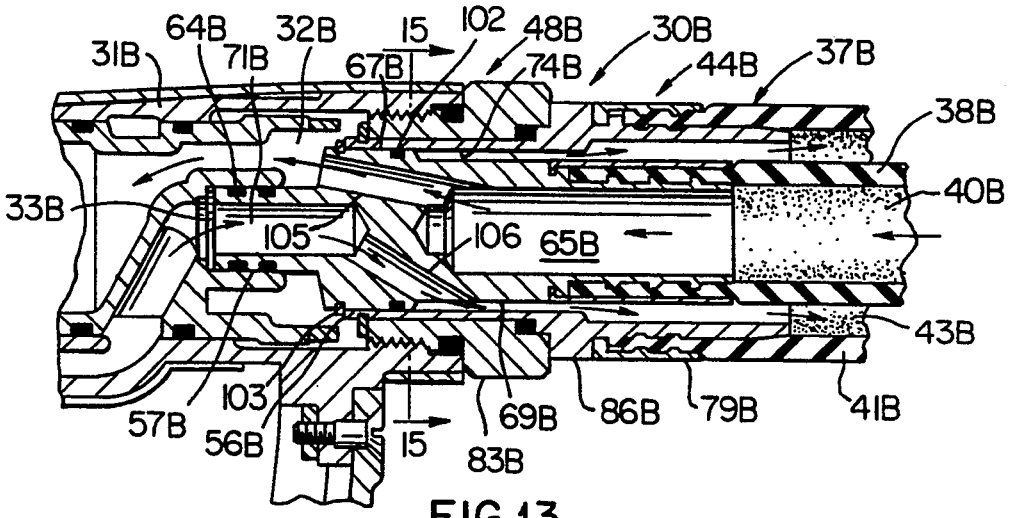
FIG. 13 is a view similar to FIG. 7 and illustrates another fuel dispensing system of this invention.
Figure 14:
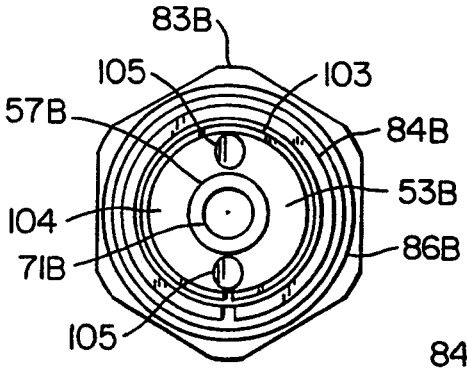
FIG. 14 is an end view of the coupling of the hose assembly of the fuel dispensing system of FIG. 13.
Figure 15:
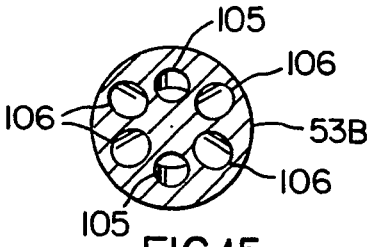
FIG. 15 is a cross-sectional view taken substantially on line 15—15 of FIG. 13.
Figure 16:
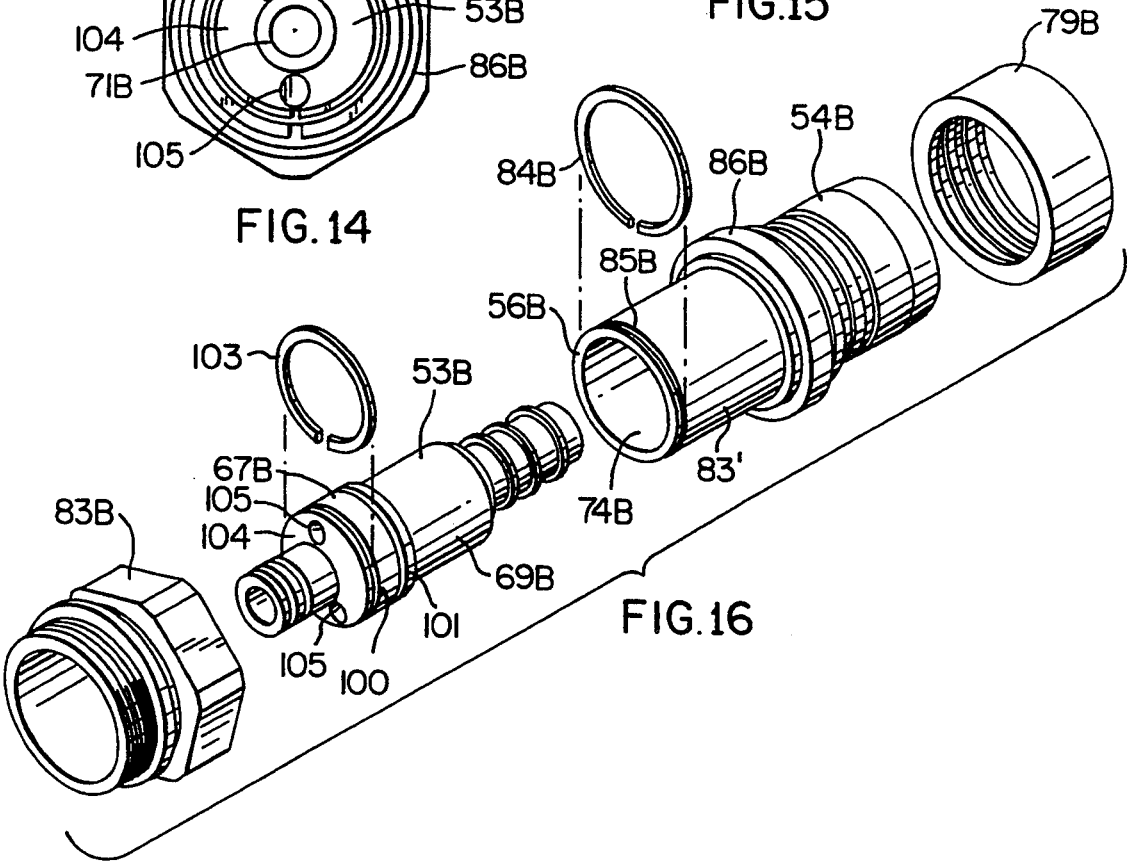
FIG. 16 is an exploded perspective view of the various parts that form the coupling for the hose assembly of FIG. 13.

In order to utilize the part 53B for its switching operation, an end surface 104 of the enlarged section 67B of the part 53B has two holes 105 drilled or otherwise formed therethrough which interconnects with the inner passage 65B of the stem portion 69B as illustrated in FIG. 13 and opposite directed holes 106 are drilled from the outer section 69B to join with the passage 71B in the tubular extension 57B of the part 53B all as illustrated in FIGS. 13, 14, 15 and 16.

After the two parts 53B and 54B have been formed in the manner previously set forth from any suitable material, such as metallic material that has been cast, machined, etc., the parts 53B and 54B can be respectively joined to the hoses 38B and 40B in the manner illustrated in FIGS. 17–20.

Figure 17:
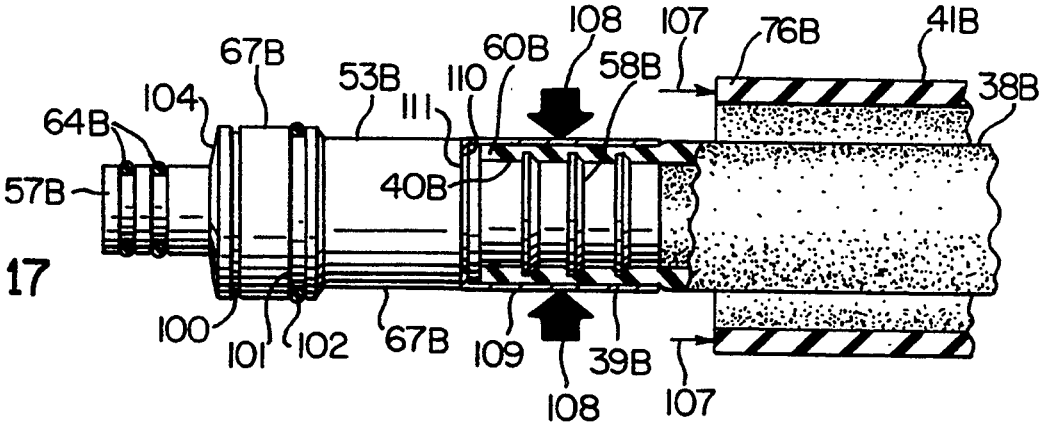
FIG. 17 is a fragmentary view that is partially in cross section and illustrates one of the steps of the method of this invention for forming the hose assembly of FIG. 13.

In particular, it can be seen in FIG. 17 that with the outer hose 41B moved to the right as indicated by the arrows 107 so as to expose the end 60B of the inner hose 38B, the barbed portion 58B of the member 53B is inserted into the passage 40B of the inner hose 38B and then an outer band or sleeve 109 is radially inwardly compressed as indicated by the arrows 108 in FIG. 17 around the outer peripheral surface 39B of the inner hose 38B to secure the same thereto. If the member 109 is a sleeve, the same can have an annular flange 110 at one end thereof received within an annular groove 111 formed in the part 68B as desired.

Figure 18:
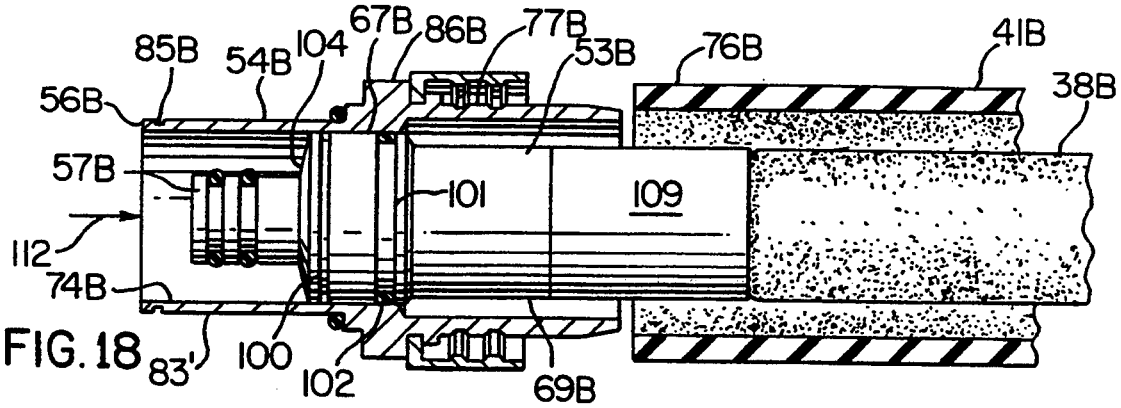
FIG. 18 is a view similar to FIG. 17 and illustrates another step in the method of making the hose assembly of FIG. 13.

In any event, after the inner hose 38B has been secured to the part 53B, the rightward compression or collapsing of the outer hose 41B can be terminated and the outer hose 41B can expand back to its original leftward position as illustrated in FIG. 18. The part 54B can then be telescoped over the part 53B in the manner indicated by the arrow 112 in FIG. 18 so as to cause the grooved end 77B of the part 54B to be received within the outer hose 41B as illustrated in FIG. 19.

Figure 19:
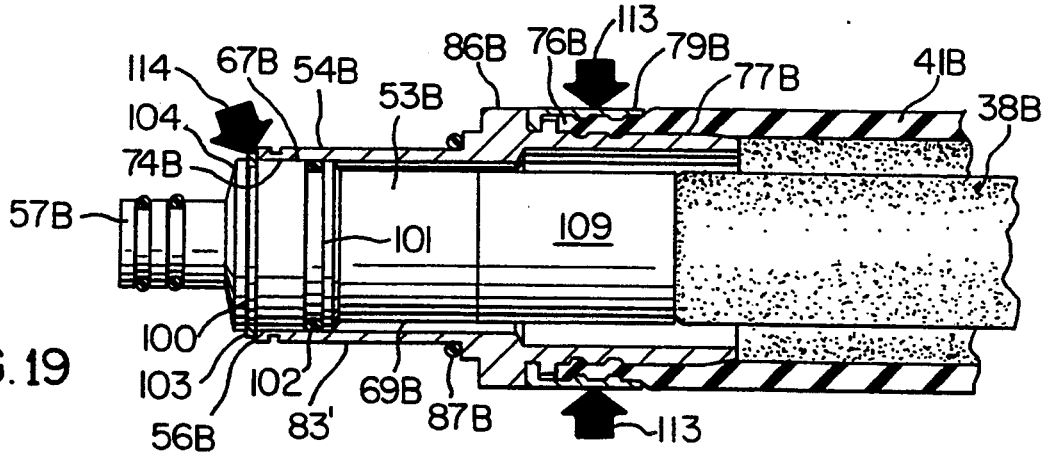
FIG. 19 is a view similar to FIG. 18 and illustrates other steps in the method of making the hose assembly of FIG.

Once the part 54B has been disposed in the position illustrated in FIG. 19, either the fastening member 79B can be first radially inwardly compressed as indicated by the arrows 113 in FIG. 19 or the fastening member 103 can be first disposed in the annular slot 100 of the member 53B as indicated by the arrow 114 of FIG. 19.

Figure 20:
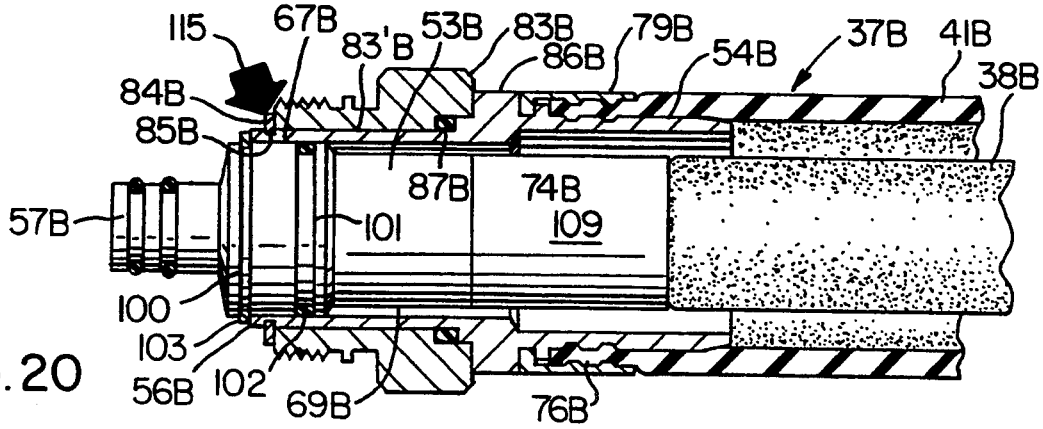
FIG. 20 is a view similar to FIG. 19 and illustrates another step in the method of making the hose assembly of FIG. 13.
Figure 21:
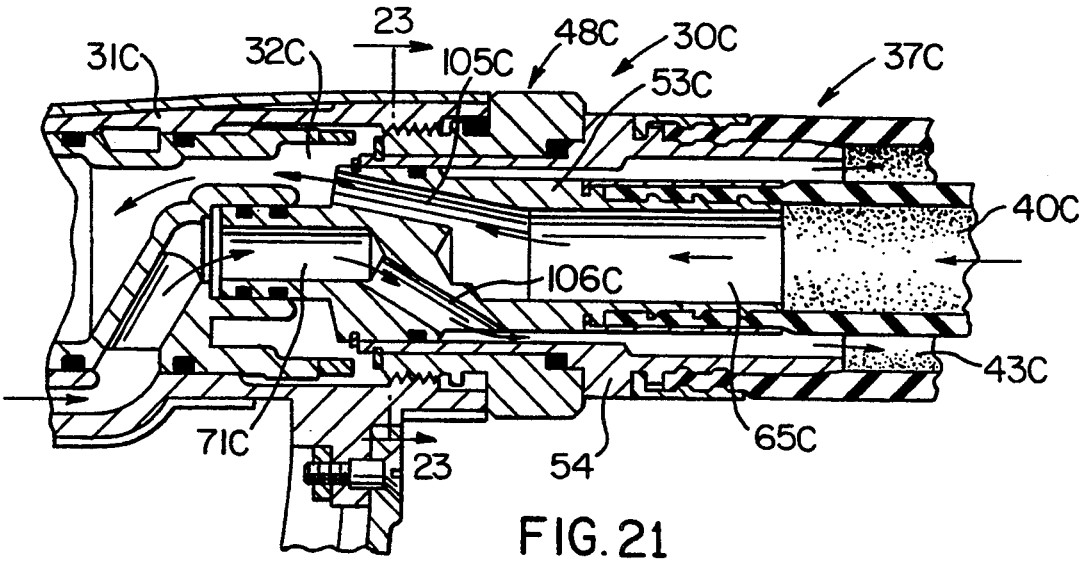
FIG. 21 is a view similar to FIG. 7 and illustrates another fuel dispensing system of this invention.
Figure 22:
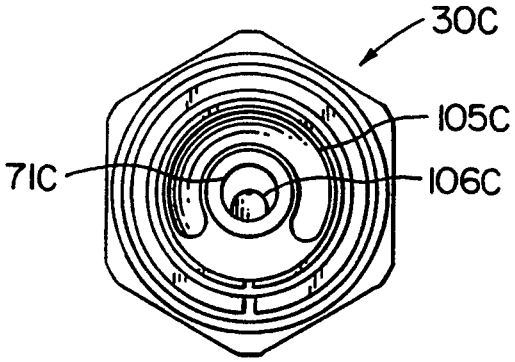
FIG. 22 is an end view of the coupling for the hose assembly of FIG. 21.
Figure 23:
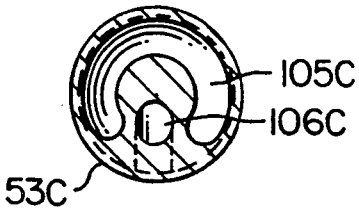
FIG. 23 is a cross-sectional view taken substantially on line 23—23 of FIG. 21.
Figure 24:
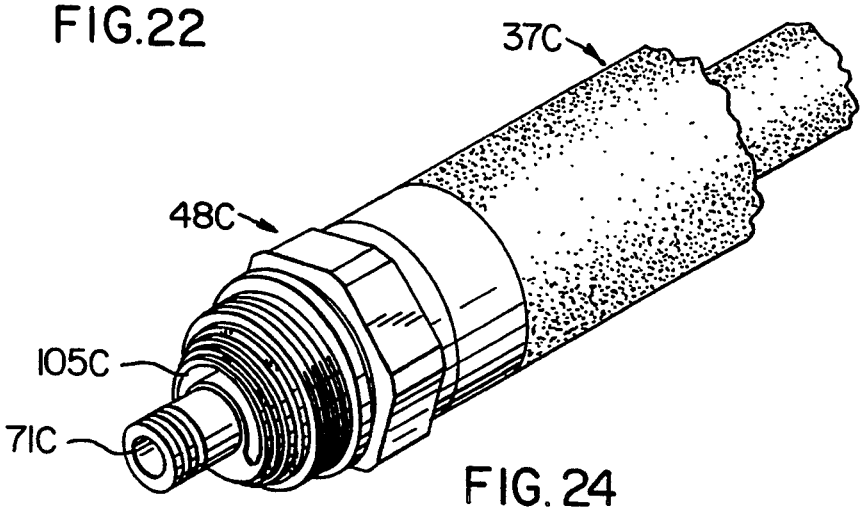
FIG. 24 is a fragmentary perspective view of one end of the hose assembly of FIG. 21.

In any event, it can be seen that after the end 76B of the outer hose 41B has been secured in place by the member 79B, the threaded member 83B can be slid onto the section 83B' of the coupling part 54B together with or after an annular sealing member 87B has been disposed thereon as illustrated in FIG. 20 so that subsequently the fastening ring 84B can be snapped in the groove 85B as illustrated by the arrow 115 of FIG. 20 to complete the securement of the coupling 48B on the hose assembly 37B with the hoses 38B and 41B respectively holding the parts 53B and 54B in their assembled relation.

Of course, it is to be understood that the other end of the hose assembly 37B is formed in the same manner as illustrated in FIGS. 17–20 if the parts 53B and 54B are being utilized to form the coupling at that end thereof as desired.

Thus, it can be seen that it is a relatively simple method of this invention to form the hose assembly 37B utilizing the coupling parts 53B and 54B of this invention for the switching function previously set forth in connection with the fluid dispensing system 30B of this invention as previously described.

Another fluid dispensing system of this invention is generally indicated by the reference numeral 30C in FIGS. 21–24 and parts thereof similar to the parts of the fuel dispensing systems 30, 30A, and 30B previously described are indicated by like reference numerals followed by the reference letter "C".

As illustrated in FIGS. 21–24, the system 30C is substantially the same as the system 30B previously described except that the part 53C of the coupling 48C has a single opening 106C formed therein to interconnect the passage 71C thereof to the outer passage 43C of the hose assembly 37C while a single passage 105C interconnects the passage 65C and, thus, the fluid passage 40C of the hose assembly 37C to the outer annular opening 32C of the nozzle construction 31C. However, the opening 105C is relatively large and can be cast or milled in the part 53C if desired.

The part 54C of the coupling 48C is formed in the same manner as the part 54B previously described whereby a further description of the operation and structure of the fluid dispensing system 30C is not necessary as the same functions in the same manner as the system 30B previously described.

While the various embodiments of this invention previously described have the inner and outer hoses of the hose assembly formed of any suitable material and in any suitable dimension to be compatible with the respective coupling of this invention for coupling to the desired nozzle constructions and pump constructions, it is to be understood that the coupling of this invention could be utilized to interconnect larger or smaller diameter hoses to the respective nozzle construction and/or pump construction as desired with the same still providing the feature of switching the inner flow passage of the hose assembly to outer flow passages of the nozzle construction and pump construction and switching the outer flow passage of the hose assembly to the inner openings of the nozzle construction and pump construction.

Figure 26:
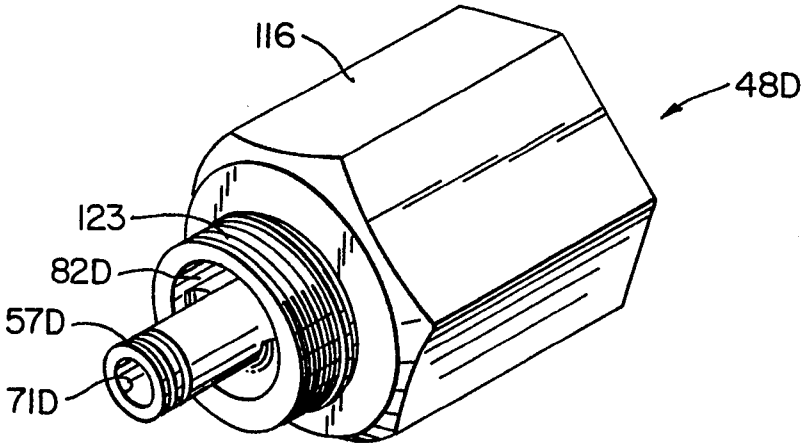
FIG. 26 is a perspective view of the coupling of the hose assembly of FIG. 25.
Figure 25:
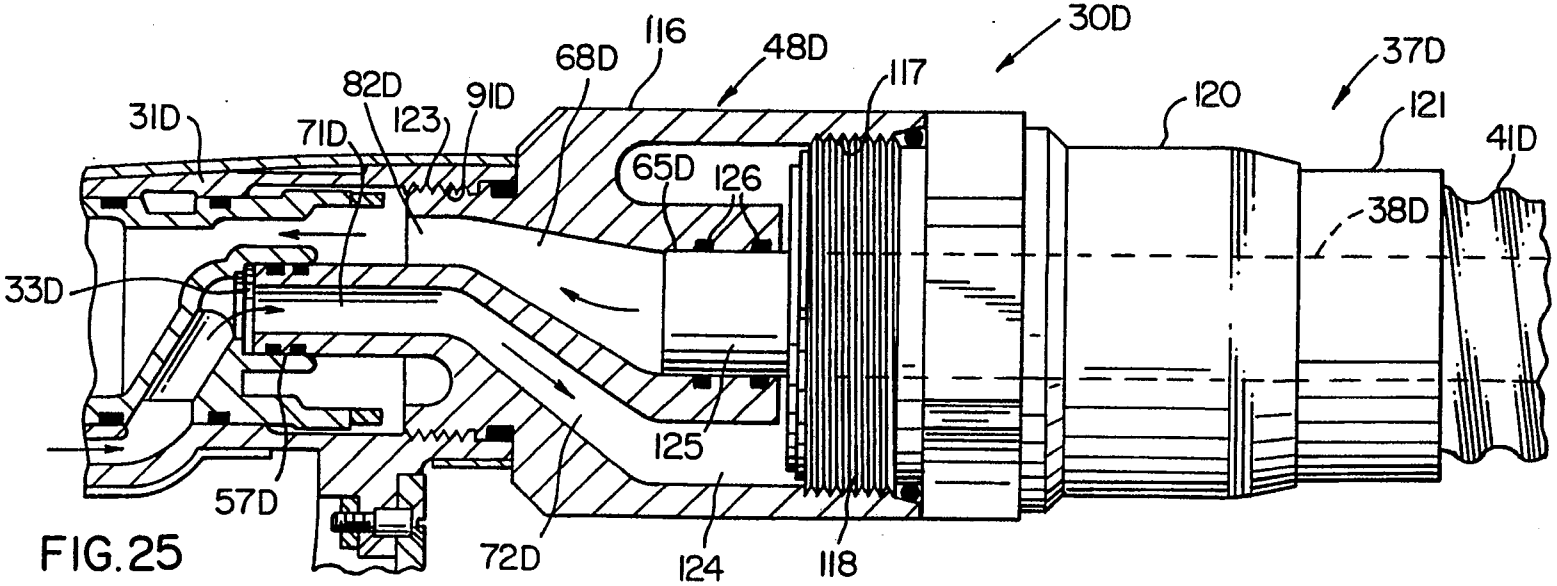
FIG. 25 is a view similar to FIG. 7 and illustrates another fuel dispensing system of this invention.

For example, another fuel dispensing system of this invention is generally indicated by the reference numeral 30D in FIGS. 25 and 26 and parts thereof similar to the parts of the systems 30, 30A, 30B and 30C previously described are indicated by like reference numerals followed by the reference letter "D".

As illustrated in FIGS. 25 and 26, the fuel dispensing system 30D comprises a coupling 48D of this invention which has an enlarged part 116 provided with internal threads 117 for coupling to a threaded member 118 of a coupling 120 on an end 121 of a hose assembly 37D, the coupling 48D comprising a one-piece member cast from metallic material or otherwise suitably formed of any suitable material and have an externally threaded section 123 threaded into the internally threaded part 91D of the nozzle construction 31D while the tubular part 57D of the coupling 48D is telescopically received in the central opening 33D of the nozzle construction 31D as illustrated. The coupling 48D is provided with passage means 68D and 72D which respectively switch an outer annular passage 124 of the coupling 48D to the passage 71D of the tubular part 57D and the outer part 82D with the central part 65D of the coupling 48D.

In this manner, the inner hose means 38D of the hose assembly 37D can have a metallic tubular end portion 125 thereof received in the passage 65D of the coupling 48D and be sealed thereto by annular seal means 126 while the threaded part 118 is interconnected to the threads 117 as illustrated, the hose construction 37D being substantially identical to the completed hose construction set forth in FIGS. 1–5 of the aforementioned Grantham U.S. Pat. No. 4,951,720, whereby the outer passage of the hose assembly that is defined between the inner hose 38D and the outer hose 41D is interconnected to the passage portion 124 of the coupling 48D.

Therefore, it can be seen that the coupling 48D of this invention readily permits previously formed hose constructions to be coupled thereto and then be coupled to the nozzle construction 31D, as well as to the pump construction 34D (not shown), to switch an inner flow passage of that prior formed hose assembly to an outer annular opening and to switch the outer fluid passage of that prior formed hose assembly to an inner opening of the nozzle construction 31D or pump construction 34D (not shown) as the case may be.

While the various couplings of this invention have been previously described as switching the fuel flow from an outer annular outlet of the pump means to the passage in an inner hose of the hose assembly and then back to an outer annular passage of the nozzle construction while returning vapors from a central opening of the nozzle's construction through an outer passage of the hose construction and then back to a central inlet of the pump construction, it is to be understood that the coupling of this invention can be utilized to switch the fluid flow through through a hose construction that is to be utilized with a nozzle construction that utilizes the inner central opening for fuel flow therethrough and the outer outlet for returning vapors and the corresponding pump means that utilizes the inner central opening for fuel flow and the outer surrounding annular opening for returning vapors from the nozzle construction.

For example, reference is again made to FIG. 27 wherein the fuel dispensing system of this invention is generally indicated by the reference numeral 30E and the parts thereof similar to the parts of the fuel dispensing systems 30, 30A, 30B, 30C and 30D previously described are indicated by like reference numerals followed by the reference letter "E".

Figure 27:
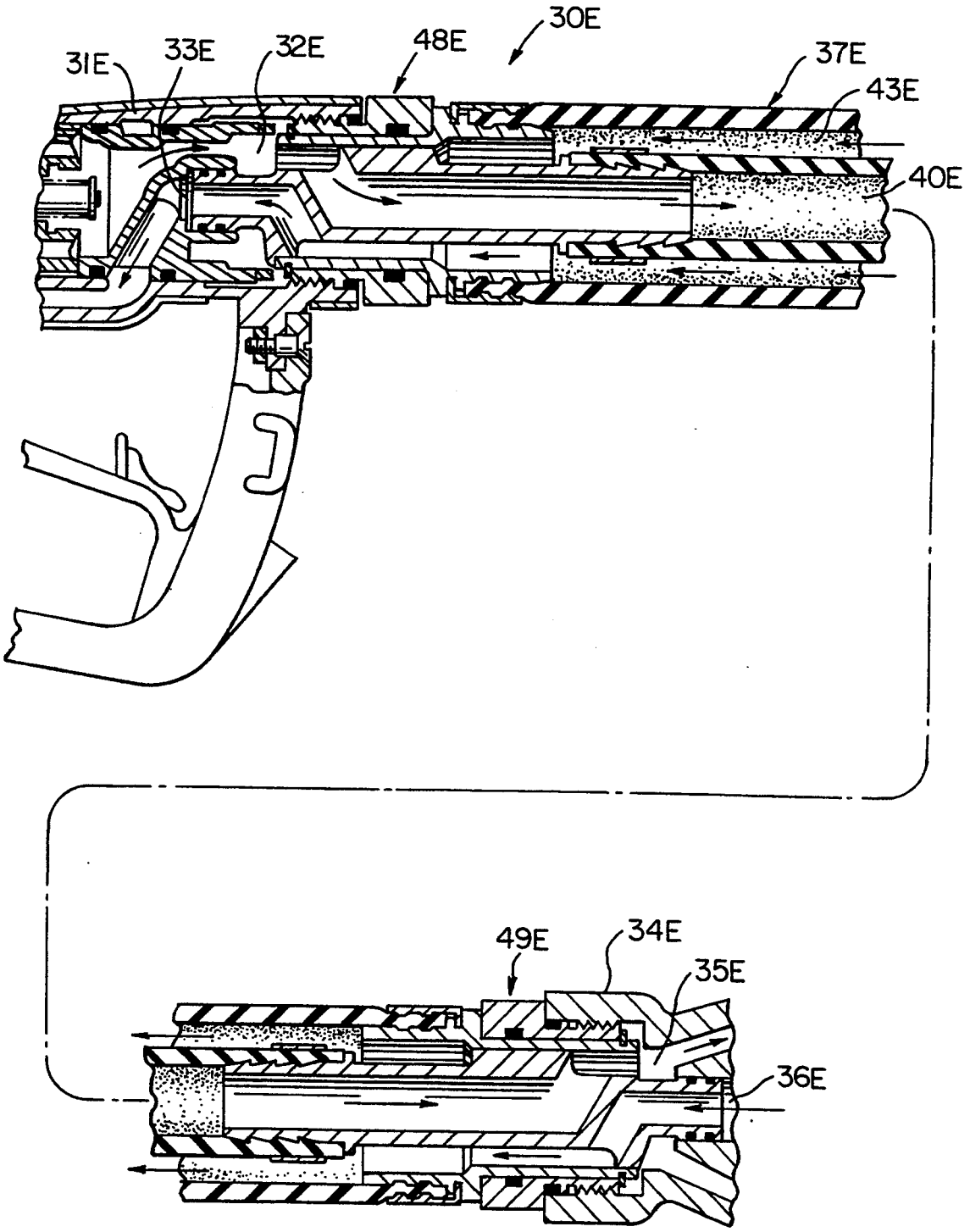
FIG. 27 is a view similar to FIG. 1 and illustrates another fuel dispensing system of this invention.

As illustrated in FIG. 27, the nozzle construction 31E has the central opening 33E for receiving fuel to be dispensed out of the nozzle end of the nozzle construction 31E from a central outlet 36E of the pump construction 34E while having a surrounding annular outlet means 32E for returning vapors to an outer surrounding inlet 35E of the pump construction 34E.

The hose assembly 37E of the system 30E has the couplings 48E and 49E at each end thereof respectively coupling with the nozzle construction 31E and pump construction 34E all in the manner previously described and it can be seen that with such arrangement, the outer fluid passage 43E is utilized for conveying liquid fuel to the nozzle construction 31E from the pump 34E and the inner passage 40E of the inner hose is utilized to return the vapor from the nozzle construction 31E back to the pump means 34E.

Thus, it can be seen that any of the couplings of this invention can be utilized to switch fluid flow for any desired purpose so as to be utilized with nozzle constructions and pump constructions which normally have different hose assemblies utilized therewith as standard practice, i.e., fuel dispensing systems comprising nozzle constructions and pump constructions that have inner fuel inlets and outlets normally utilize hose assemblies where the fuel flow is through the inner hoses thereof and fuel dispensing systems comprising nozzle constructions and pump constructions that have outer annular fuel inlets and outlets normally utilize hose assemblies where the fuel flow is through the outer passages of the hose assemblies now respectively have the option of utilizing either type of hose assembly therewith. However, it is to be understood that the hose assemblies need not be presently designed hose assemblies as the hose assemblies can be specifically designed to be utilized with the couplings of this invention.

Also, while it is believed that the couplings of this invention can each be formed of aluminum containing metallic material, it is to be understood that any other suitable material can be utilized, as desired. Similarly, the hose assemblies of this invention can have the inner and outer hoses thereof formed of any suitable material, such as polymeric material, or combinations of materials as desired and can be corrugated or be uncorrugated or be any combination of corrugated and uncorrugated, etc., as desired.

Figure 29:
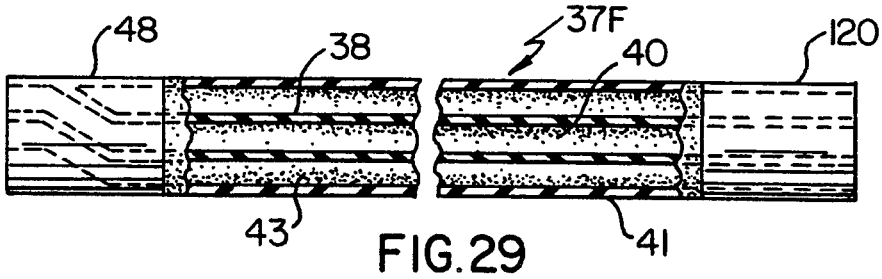
FIG. 29 is a schematic view partially in cross section and illustrates another new hose assembly of this invention.
Figure 30:
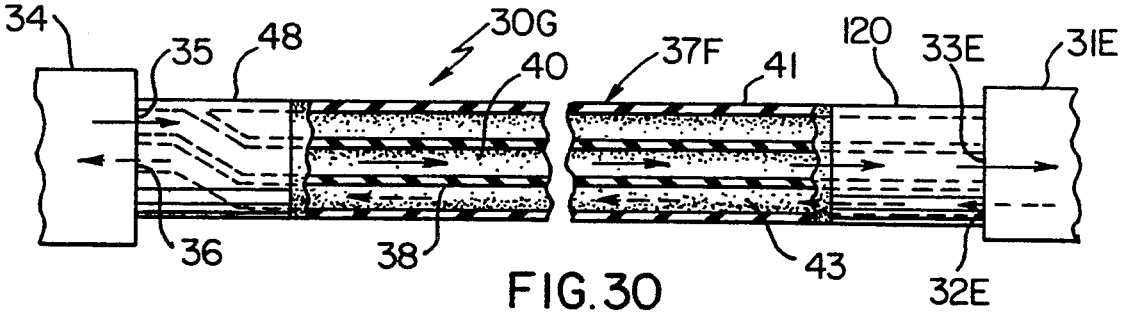
FIG. 30 is a schematic view partially in cross section and illustrates another new fuel dispensing system of this invention that utilizes the hose assembly of FIG. 29.
Figure 31:
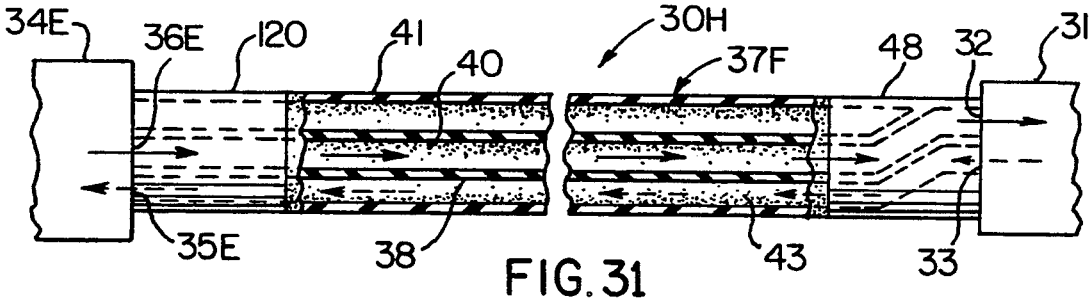
FIG. 31 is a view similar to FIG. 30 and illustrates another new fuel dispensing system of this invention.
Figure 32:
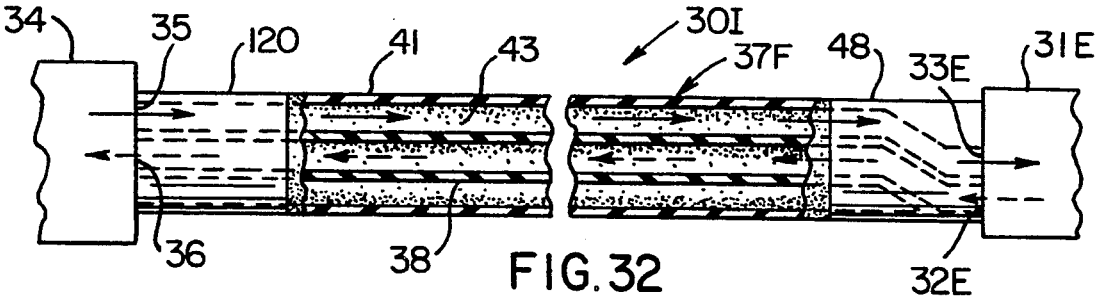
FIG. 32 is a view similar to FIG. 30 and illustrates another new fuel dispensing system of this invention.

It is also to be understood that the coupling of this invention, such as coupling 48, can be secured to one end of a hose assembly and a coupling similar to the coupling 120 of FIG. 25 can be interconnected to the other end of the hose assembly whereby such a hose assembly of this invention is generally indicated by the reference numeral 37F in FIG. 29 and then can have the coupling 48 thereof interconnected to a pump construction 34 and have the coupling 120 interconnected to a nozzle construction 31E to form a new fuel dispensing system of this invention that is generally indicated by the reference numeral 30G in FIG. 30 and wherein fuel issuing out of the outer outlet 35 of the pump construction 34 will be switched by the coupling 48 to the inner passage 40 of the inner hose 38 of the hose assembly 37F to be directed into the inner inlet 33E of the nozzle construction 31E or can have the coupling 48 thereof interconnected to a nozzle construction 31 and have the coupling 120 interconnected to a pump construction 34E to form a new fuel dispensing system of this invention that is generally indicated by the reference numeral 30H in FIG. 31 and wherein fuel that issues out of the inner outlet 36E of the pump construction 34E into the inner passage 40 of the inner hose 38 of the hose assembly 37F by the coupling 120 will be switched by the coupling 48 to the outer inlet 32 of the nozzle construction 31. Conversely, the coupling 120 of such hose assembly can be interconnected to a pump construction 34 and the coupling 48 can be interconnected to a nozzle construction 31E to form a new fuel dispensing system of this invention that is generally indicated by the reference numeral 30I in FIG. 32 and wherein fuel issuing out of the outer outlet 35 of the pump construction 34 into the outer passage 43 of the hose assembly 37F by the coupling 120 can be switched by the coupling 48 to enter the inner inlet 33E of the nozzle construction 31E or can have the coupling 48 thereof interconnected to a pump construction 34E and the coupling 120 interconnected to a nozzle construction 31 to form a new fuel dispensing system of this invention that is generally indicated by the reference numeral 30J in FIG. 33 and wherein fuel issuing out of the inner outlet 36E of the pump construction 34E will be switched by the coupling 48 to the outer passage 43 of the hose assembly 37F to be fed into the outer inlet 32 of the nozzle construction 31 by the coupling 120. Of course, in each of the above arrangements the vapor is returned from the particular nozzle construction to the particular pump construction in a similar manner and as indicated by dashed arrows whereas the fuel flow is indicated by full arrows.

Figure 33:
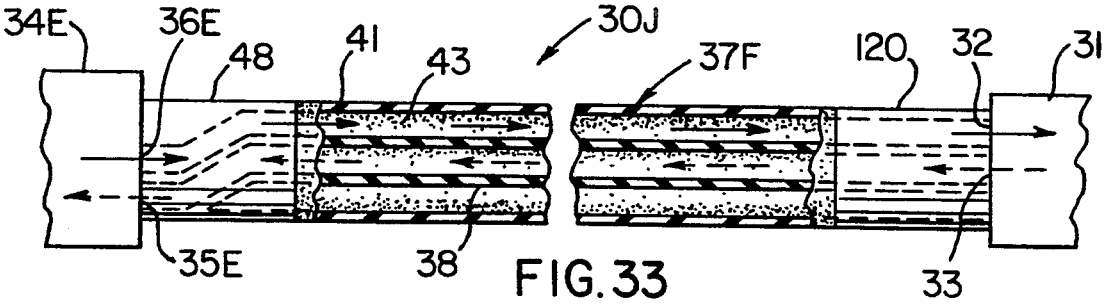
FIG. 33 is a view similar to FIG. 30 and illustrates another new fuel dispensing system of this invention.

From the above, it can be seen in FIGS. 30 and 31 that the fuel flow is through the inner hose 38 of the hose assembly 37F whereas in FIGS. 33 and 34 the fuel flow is through the outer passage 43 defined between the outer hose 41 and the inner hose 38 of the hose assembly 37F.

Thus, it can be seen that the hose assembly of this invention can have dissimilar couplings at each end thereof so as to provide different fuel dispensing systems of this invention that have dissimilar pump constructions and nozzle constructions.

Therefore, the hose assembly 37F for the systems 30G and 30H could have only the inner hose 38 designed for conveying fuel therethrough and the hose assembly 37F for the systems 30I and 30J could have the hoses 38 and 41 thereof designed for only conveying fuel through the outer passage 43 thereof. Of course, a universal hose assembly 37F could have the hoses 38 and 41 thereof designed to be utilized not only in all of the systems 30G, 30H, 30I and 30J but also to be utilized any of the other systems of this invention previously described so as to be utilized with any set of couplings whether those couplings are similar or dissimilar.

In addition, the outer hose 41 of any of the hose assemblies of this invention could be designed for other particular uses, such as for permitting the hose assembly to be wound up on a reel when in the non fuel dispensing condition thereof, etc.

Therefore, it can be seen that this invention not only provides new fuel dispensing systems and new methods of making the same but also this invention provides new hose assemblies and new couplings therefor as well as new methods of making such hose assemblies and such couplings.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fuel dispensing system comprising a fuel dispensing nozzle construction having a central coupling axis of rotation therein and having an outer fuel receiving inlet and an inner vapor outlet disposed radially closer to said central coupling axis of rotation thereof than said outer fuel receiving inlet, a fuel dispensing pump construction having a central coupling axis of rotation therein and having an outer fuel dispensing outlet and an inner vapor inlet disposed radially closer to said central coupling axis of rotation thereof than said outer fuel dispensing outlet, and a hose assembly having a first fluid passage therein for conveying fuel from said outer fuel dispensing outlet to said outer fuel receiving inlet and a second fluid passage therein for returning vapors from said inner vapor outlet to said inner vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement wherein said inner fluid passage comprises said first fluid passage and said outer fluid passage comprises said second fluid passage.

2. A fuel dispensing system as set forth in claim 1 wherein said system has interconnecting means interconnecting said inner fluid passage to said outer fuel dispensing outlet and said outer fuel receiving inlet and for interconnecting said outer fluid passage to said inner vapor outlet and said inner vapor inlet whereby said inner fluid passage comprises said first fluid passage and said outer fluid passage comprises said second fluid passage.

3. A fuel dispensing system as set forth in claim 2 wherein said interconnecting means comprises part of said hose assembly.

4. A fuel dispensing system as set forth in claim 2 wherein said hose assembly has opposed ends one of which is interconnected to said nozzle construction by said interconnecting means and the other of which is interconnected to said pump construction by said interconnecting means.

5. A fuel dispensing system as set forth in claim 4 wherein said interconnecting means comprises two like couplings respectively interconnected to said opposed ends of said hose assembly and respectively interconnected to said nozzle construction and said pump construction.

6. A fuel dispensing system as set forth in claim 5 wherein each said coupling comprises means for switching said inner fluid passage to an outer location on said coupling and for switching said outer fluid passage to an inner location on said coupling.

7. A fuel dispensing system as set forth in claim 6 wherein each said coupling comprises a one-piece homogeneous part.

8. A fuel dispensing system as set forth in claim 6 wherein each said coupling comprises two parts assembled together in telescoping relation.

9. A fuel dispensing system as set forth in claim 8 wherein each said coupling has said two parts thereof secured together to provide a self-contained unit.

10. A fuel dispensing system as set forth in claim 8 wherein each said coupling has said two parts thereof held together by said inner and outer hoses.

11. In a hose assembly for a fuel dispensing system comprising a fuel dispensing nozzle construction having a central coupling axis of rotation therein and having an outer fuel receiving inlet and an inner vapor outlet disposed radially closer to said central coupling axis of rotation thereof than said outer fuel receiving inlet and a fuel dispensing pump construction having a central coupling axis of rotation therein and having an outer fuel dispensing outlet and an inner vapor inlet disposed radially closer to said central coupling axis of rotation thereof than said outer fuel dispensing outlet, said hose assembly having a first fluid passage therein for conveying fuel from said outer fuel dispensing outlet to said outer fuel receiving inlet and a second fluid passage therein for returning vapors from said inner vapor outlet to said inner vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement wherein said inner fluid passage comprises said first fluid passage and said outer fluid passage comprises said second fluid passage.

12. A hose assembly as set forth in claim 11 wherein said hose assembly has interconnecting means for interconnecting said inner fluid passage to said outer fuel dispensing outlet and said outer fuel receiving inlet and for interconnecting said outer fluid passage to said inner vapor outlet and said inner vapor inlet whereby said inner fluid passage and said outer fluid passage comprises said second fluid passage.

13. A hose assembly as set forth in claim 12 wherein said interconnecting means comprises part of said hose assembly.

14. A hose assembly as set forth in claim 12 wherein said hose assembly has opposed ends one of which is adapted to be interconnected to said nozzle construction by said interconnecting means and the other of which is adapted to be interconnected to said pump construction by said interconnecting means.

15. A hose assembly as set forth in claim 14 wherein said interconnecting means comprises two like couplings respectively interconnected to said opposed ends of said hose assembly and being adapted to be respectively interconnected to said nozzle construction and said pump construction.

16. A hose assembly as set forth in claim 15 wherein each said coupling comprises means for switching said inner fluid passage to an outer location on said coupling and for switching said outer fluid passage to an inner location on said coupling.

17. A hose assembly as set forth in claim 16 wherein each said coupling comprises a one-piece homogeneous part.

18. A hose assembly as set forth in claim 16 wherein each said coupling comprises two parts assembled together in telescoping relation.

19. A hose assembly as set forth in claim 18 wherein each said coupling has said two parts thereof secured together to provide a self-contained unit.

20. A hose assembly as set forth in claim 18 wherein each said coupling has said two parts thereof held together by said inner and outer hoses.

21. In a coupling for one end of a hose assembly for a fuel dispensing system comprising a fuel dispensing nozzle construction having a central coupling axis of rotation therein and having an outer fuel receiving inlet and an inner vapor outlet disposed radially closer to said central coupling axis of rotation thereof than said outer fuel receiving inlet, a fuel dispensing pump construction having a central coupling axis of rotation therein and having an outer fuel dispensing outlet and an inner vapor inlet disposed radially closer to said central coupling axis of rotation thereof than said outer fuel dispensing outlet, said hose assembly having a first fluid passage therein for conveying fuel from said outer fuel dispensing outlet to said outer fuel receiving inlet and a second fluid passage therein for returning vapors from said inner vapor outlet to said inner vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement wherein said coupling has means adapted to cause said inner fluid passage of said hose assembly to comprise said first fluid passage and said outer fluid passage to comprise said second fluid passage.

22. A coupling as set forth in claim 21 wherein said coupling comprises means for switching said inner fluid passage at said one end of said hose assembly to an outer location on said coupling and for switching said outer fluid passage at said one end of said hose assembly to an inner location on said coupling.

23. A coupling as set forth in claim 22 wherein said coupling comprises a one-piece homogeneous part.

24. A coupling as set forth in claim 22 wherein said coupling comprises two parts assembled together in telescoping relation.

25. A coupling as set forth in claim 24 wherein said coupling has said two parts thereof secured together to provide a self-contained unit.

26. A coupling as set forth in claim 24 wherein said coupling has said two parts thereof adapted to be held together by said inner and outer hoses of said hose assembly.

27. A coupling as set forth in claim 22 wherein said coupling has means for attaching to said inner and outer hoses of said hose assembly at said one end thereof so as to be carried by said hose assembly.

28. In a method of making a fuel dispensing system comprising a fuel dispensing nozzle construction having a central coupling axis of rotation therein and having an outer fuel receiving inlet and an inner vapor outlet disposed radially closer to said central coupling axis of rotation thereof than said outer fuel receiving inlet, a fuel dispensing pump construction having a central coupling axis of rotation therein and having an outer fuel dispensing outlet and an inner vapor inlet disposed radially closer to said central coupling axis of rotation thereof than said outer fuel dispensing outlet, said hose assembly having a first fluid passage therein for conveying fuel from said outer fuel dispensing outlet to said outer fuel receiving inlet and a second fluid passage therein for returning vapors from said inner vapor outlet to said inner vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement comprising the step of coupling the opposed ends of said hose assembly respectively to said nozzle construction and said pump construction so that said inner fluid passage comprises said first fluid passage and said outer fluid passage comprises said second fluid passage.

29. In a method of making a hose assembly for a fuel dispensing system comprising a fuel dispensing nozzle construction having a central coupling axis of rotation therein and having an outer fuel receiving inlet and an inner vapor outlet disposed radially closer to said central coupling axis of rotation thereof than said outer fuel receiving inlet and a fuel dispensing pump construction having a central coupling axis of rotation therein and having an outer fuel dispensing outlet and an inner vapor inlet disposed radially closer to said central coupling axis of rotation thereof than said outer fuel dispensing outlet, said hose assembly having a first fluid passage therein for conveying fuel from said outer fuel dispensing outlet to said outer fuel receiving inlet and a second fluid passage therein for returning vapors from said inner vapor outlet to said inner vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement comprising the step of forming the opposed ends of said hose assembly to be adapted to be respectively coupled to said nozzle construction and to said pump construction so that said inner fluid passage comprises said first fluid passage and said outer fluid passage comprises said second fluid passage.

30. In a method of making a coupling for one end of a hose assembly for a fuel dispensing system comprising a fuel dispensing nozzle construction having a central coupling axis of rotation therein and having an outer fuel receiving inlet and an inner vapor outlet disposed radially closer to said central coupling axis of rotation thereof than said outer fuel receiving inlet, a fuel dispensing pump construction having a central coupling axis of rotation therein and having an outer fuel dispensing outlet and an inner vapor inlet disposed radially closer to said central coupling axis of rotation thereof than said outer fuel dispensing outlet, said hose assembly having a first fluid passage therein for conveying fuel from said outer fuel dispensing outlet to said outer fuel receiving inlet and a second fluid passage therein for returning vapors from said inner vapor outlet to said inner vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement comprising the step of forming said coupling to have means adapted to cause said inner fluid passage of said hose assembly to comprise said first fluid passage and said outer fluid passage to comprise said second fluid passage.

31. In a fuel dispensing system comprising a fuel dispensing nozzle construction having a central coupling axis of rotation therein and having an inner fuel receiving inlet and an outer vapor outlet disposed radially farther from said central coupling axis of rotation thereof than said inner fuel receiving inlet, a fuel dispensing pump construction having a central coupling axis of rotation therein and having an inner fuel dispensing outlet and an outer vapor inlet disposed radially farther from said central coupling axis of rotation thereof than said inner fuel dispensing outlet, and a hose assembly having a first fluid passage therein for conveying fuel from said inner fuel dispensing outlet to said inner fuel receiving inlet and a second fluid passage therein for returning vapors from said outer vapor outlet to said outer vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement wherein said outer fluid passage comprises said first fluid passage and said inner fluid passage comprises said second fluid passage.

32. In a hose assembly for a fuel dispensing system comprising a fuel dispensing nozzle construction having a central coupling axis of rotation therein and having an inner fuel receiving inlet and an outer vapor outlet disposed radially farther from said central coupling axis of rotation thereof than said inner fuel receiving inlet and a fuel dispensing pump construction having a central coupling axis of rotation therein and having an inner fuel dispensing outlet and an outer vapor inlet disposed radially farther from said central coupling axis of rotation thereof than said inner fuel dispensing outlet, said hose assembly having a first fluid passage therein for conveying fuel from said inner fuel dispensing outlet to said inner fuel receiving inlet and a second fluid passage therein for returning vapors from said outer vapor outlet to said outer vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement wherein said outer fluid passage comprises said first fluid passage and said inner fluid passage comprises said second fluid passage.

33. In a coupling for one end of a hose assembly for a fuel dispensing system comprising a fuel dispensing nozzle construction having a central coupling axis of rotation therein and having an inner fuel receiving inlet and an outer vapor outlet disposed radially farther from said central coupling axis of rotation thereof than said inner fuel receiving inlet, a fuel dispensing pump construction having a central coupling axis of rotation therein and having an inner fuel dispensing outlet and an outer vapor inlet disposed radially farther from said central coupling axis of rotation thereof than said inner fuel dispensing outlet, said hose assembly having a first fluid passage therein for conveying fuel from said inner fuel dispensing outlet to said inner fuel receiving inlet and a second fluid passage therein for returning vapors from said outer vapor outlet to said outer vapor inlet, said hose assembly comprising a flexible inner hose having an outer peripheral surface and defining an inner fluid passage therein, and a flexible outer hose having an inner peripheral surface and being disposed around said inner hose, said inner peripheral surface of said outer hose and said outer peripheral surface of said inner hose defining an outer fluid passage therebetween, the improvement wherein said coupling has means adapted to cause said outer fluid passage of said hose assembly to comprise said first fluid passage and said inner fluid passage to comprise said second fluid passage.

34. In a fuel dispensing system comprising a fuel dispensing nozzle construction having a fuel receiving inlet and a vapor outlet, a fuel dispensing pump construction having a fuel dispensing outlet and a vapor inlet, and a hose assembly having a first fluid passage therein for conveying fuel from said fuel dispensing outlet to said fuel receiving inlet and a second fluid passage therein for returning vapors from said vapor outlet to said vapor inlet, said hose assembly comprising a flexible inner hose having an outer peripheral surface and defining an inner fluid passage therein that comprises one of said first fluid passage and said second fluid passage, and a flexible outer hose having an inner peripheral surface and being disposed around said inner hose, said inner peripheral surface of said outer hose and said outer peripheral surface of said inner hose defining an outer fluid passage therebetween that comprises the other of said first fluid passage and said second fluid passage, said hose assembly having couplings at opposed ends thereof respectively interconnected to said nozzle construction and said pump construction, the improvement wherein at least one of said couplings has a central coupling axis of rotation therein and has means switching said inner fluid passage of said hose assembly at its respective end of said hose assembly to an outer location on said coupling and switching said outer fluid passage at its respective end of said hose assembly to an inner location on said coupling that is disposed radially closer to said central coupling axis of rotation than said outer location.

35. In a hose assembly for a fuel dispensing system comprising a fuel dispensing nozzle construction having a fuel receiving inlet and a vapor outlet and a fuel dispensing pump construction having a fuel dispensing outlet and a vapor inlet, said hose assembly having a first fluid passage therein for conveying fuel from said fuel dispensing outlet to said fuel receiving inlet and a second fluid passage therein for returning vapors from said vapor outlet to said vapor inlet, said hose assembly comprising a flexible inner hose having an outer peripheral surface and defining an inner passage therein that comprises one of said fluid passage and said second fluid passage, and a flexible outer hose having an inner peripheral surface and being disposed around said inner hose, said inner peripheral surface of said outer hose and said outer peripheral surface of said inner hose defining an outer fluid passage therebetween that comprises the other of said first fluid passage and said second fluid passage, said hose assembly having couplings at opposed ends thereof for respectively interconnecting with said nozzle construction and said pump construction, the improvement wherein at least one of said couplings has a central coupling axis of rotation therein and has means switching said inner fluid passage of said hose assembly at its respective end of said hose assembly to an outer location on said coupling and switching said outer fluid passage at its respective end of said hose assembly to an inner location on said coupling that is disposed radially closer to said central coupling axis of rotation than said outer location.

36. In a coupling for one end of a hose assembly for a fuel dispensing system comprising a fuel dispensing nozzle construction having a fuel receiving inlet and a vapor outlet and a fuel dispensing pump construction having a fuel dispensing outlet and a vapor inlet, said hose assembly having a first fluid passage therein for conveying fuel from said fuel dispensing outlet to said fuel receiving inlet and a second fluid passage therein for returning vapors from said vapor outlet to said vapor inlet, said hose assembly comprising a flexible inner hose having an outer peripheral surface and defining an inner fluid passage therein that comprises one of said first fluid passage and said second fluid passage, and a flexible outer hose having an inner peripheral surface and being disposed around said inner hose, said inner peripheral surface of said outer hose and said outer peripheral surface of said inner hose defining an outer fluid passage therebetween that comprises the other of said first fluid passage and said second fluid passage, the improvement wherein said coupling has a central coupling axis of rotation therein and has means adapted to switch said inner fluid passage of said hose assembly at said one end of said hose assembly to an outer location on said coupling and to switch said outer fluid passage at said one end of said hose assembly to an inner location on said coupling that is disposed radially closer to said central coupling axis of rotation than said outer location.

* * * * *